US008911924B2

(12) United States Patent
Sato et al.

(10) Patent No.: US 8,911,924 B2
(45) Date of Patent: Dec. 16, 2014

(54) TONER AND METHOD FOR PRODUCING THE SAME

(75) Inventors: Tomoyuki Sato, Kanagawa (JP); Naohiro Watanabe, Shizuoka (JP); Tsuyoshi Sugimoto, Shizuoka (JP); Shinya Hanatani, Shizuoka (JP); Mamoru Hozumi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 75 days.

(21) Appl. No.: 13/877,010

(22) PCT Filed: Oct. 13, 2011

(86) PCT No.: PCT/JP2011/074088

§ 371 (c)(1),
(2), (4) Date: Mar. 29, 2013

(87) PCT Pub. No.: WO2012/050231

PCT Pub. Date: Apr. 19, 2012

(65) Prior Publication Data

US 2013/0209931 A1 Aug. 15, 2013

(30) Foreign Application Priority Data

Oct. 14, 2010 (JP) ..... 2010-231949
Sep. 12, 2011 (JP) ..... 2011-198761

(51) Int. Cl.
*G03G 9/08* (2006.01)
*G03G 9/087* (2006.01)

(52) U.S. Cl.
CPC ..... *G03G 9/08755* (2013.01); *G03G 9/0821* (2013.01); *G03G 9/0804* (2013.01); *G03G 9/0817* (2013.01); *G03G 9/0815* (2013.01); *G03G 9/0808* (2013.01); *G03G 9/08797* (2013.01)
USPC ..... 430/109.4; 430/137.14

(58) Field of Classification Search
CPC ..... G03G 9/08755; G03G 9/08797
USPC ..... 430/109.4, 137.14
See application file for complete search history.

(56) References Cited

U.S. PATENT DOCUMENTS 6,936,390 B2 8/2005 Nanya et al.
7,056,638 B1 6/2006 Tomita et al.
7,303,847 B2 12/2007 Tomita et al.
(Continued)

FOREIGN PATENT DOCUMENTS

JP 2004-286842 10/2004
JP 2006-065015 3/2006
(Continued)

OTHER PUBLICATIONS

International Search Report Issued Dec. 27, 2011 in PCT/JP11/74088 Filed Oct. 13, 2011.

*Primary Examiner* — Mark A Chapman
(74) *Attorney, Agent, or Firm* — Oblon, Spivak, McClelland, Maier & Neustadt, L.L.P.

(57) ABSTRACT

A toner including base particles each containing a crystalline polyester and a non-crystalline polyester, wherein the toner has a glass transition temperature of 45° C. or higher where the glass transition temperature is determined from a DSC curve of the toner obtained in the first elevation of temperature thereof, and wherein the toner has a temperature width of 8° C. or lower where the temperature width is a temperature width at ⅓ the height of an endothermic peak attributed to the crystalline polyester in the DSC curve.

10 Claims, 1 Drawing Sheet

(56) References Cited

U.S. PATENT DOCUMENTS

| | | | |
|---|---|---|---|
| 7,435,521 | B2 | 10/2008 | Yagi et al. |
| 7,449,273 | B2 | 11/2008 | Ohki et al. |
| 7,459,255 | B2 | 12/2008 | Tanaka et al. |
| 7,504,188 | B2 | 3/2009 | Yamada et al. |
| 7,531,279 | B2 | 5/2009 | Watanabe et al. |
| 8,227,164 | B2 | 7/2012 | Sugimoto et al. |
| 2003/0027074 | A1 | 2/2003 | Emoto et al. |
| 2003/0134220 | A1 | 7/2003 | Emoto et al. |
| 2003/0138717 | A1 | 7/2003 | Yagi et al. |
| 2003/0152859 | A1 | 8/2003 | Emoto et al. |
| 2003/0162112 | A1 | 8/2003 | Yamashita et al. |
| 2004/0131961 | A1 | 7/2004 | Watanabe et al. |
| 2004/0142264 | A1 | 7/2004 | Tanaka et al. |
| 2004/0175641 | A1 | 9/2004 | Nanya et al. |
| 2004/0265721 | A1 | 12/2004 | Matsuoka et al. |
| 2005/0003291 | A1 | 1/2005 | Takada et al. |
| 2005/0026066 | A1 | 2/2005 | Tanaka et al. |
| 2005/0031980 | A1 | 2/2005 | Inoue et al. |
| 2005/0042534 | A1 | 2/2005 | Tanaka et al. |
| 2005/0164112 | A1 | 7/2005 | Ohki et al. |
| 2005/0277044 | A1 | 12/2005 | Watanabe et al. |
| 2005/0277045 | A1 | 12/2005 | Saito et al. |
| 2006/0057487 | A1 | 3/2006 | Nagayama et al. |
| 2006/0057488 | A1 | 3/2006 | Inoue et al. |
| 2006/0068312 | A1 | 3/2006 | Yamashita et al. |
| 2006/0099529 | A1 | 5/2006 | Tanaka et al. |
| 2006/0160011 | A1 | 7/2006 | Inoue et al. |
| 2006/0177756 | A1 | 8/2006 | Sugimoto et al. |
| 2006/0210903 | A1 | 9/2006 | Ohki et al. |
| 2006/0216626 | A1 | 9/2006 | Sacripante et al. |
| 2006/0240349 | A1 | 10/2006 | Watanabe et al. |
| 2006/0269860 | A1 | 11/2006 | Nanya et al. |
| 2007/0015077 | A1 | 1/2007 | Yamashita et al. |
| 2007/0031752 | A1 | 2/2007 | Watanabe et al. |
| 2007/0042284 | A1 | 2/2007 | Takada et al. |
| 2007/0054210 | A1 | 3/2007 | Ohki et al. |
| 2007/0059626 | A1 | 3/2007 | Inoue et al. |
| 2007/0095023 | A1 | 5/2007 | Hanatani et al. |
| 2007/0141500 | A1 | 6/2007 | Sugimoto et al. |
| 2007/0141506 | A1 | 6/2007 | Inoue et al. |
| 2007/0218380 | A1 | 9/2007 | Uchinokura et al. |
| 2007/0218381 | A1 | 9/2007 | Uchinokura et al. |
| 2007/0218382 | A1 | 9/2007 | Emoto et al. |
| 2007/0218392 | A1 | 9/2007 | Yamada et al. |
| 2008/0069616 | A1 | 3/2008 | Kojima et al. |
| 2008/0070144 | A1 | 3/2008 | Nagatomo et al. |
| 2008/0070151 | A1 | 3/2008 | Sugimoto et al. |
| 2008/0227002 | A1 | 9/2008 | Moriya et al. |
| 2008/0233505 | A1 | 9/2008 | Nagatomo et al. |
| 2008/0280218 | A1 | 11/2008 | Sabu et al. |
| 2008/0318144 | A1 | 12/2008 | Watanabe et al. |
| 2008/0318148 | A1 | 12/2008 | Sugimoto et al. |
| 2009/0092917 | A1 | 4/2009 | Sugimoto et al. |
| 2009/0104555 | A1 | 4/2009 | Wakamatsu et al. |
| 2009/0117480 | A1 | 5/2009 | Yamada et al. |
| 2009/0155709 | A1 | 6/2009 | Watanabe et al. |
| 2009/0214973 | A1 | 8/2009 | Sugimoto et al. |
| 2009/0233204 | A1 | 9/2009 | Watanabe et al. |
| 2009/0325099 | A1 | 12/2009 | Watanabe et al. |
| 2010/0035170 | A1 | 2/2010 | Sugimoto et al. |
| 2010/0075243 | A1 | 3/2010 | Shimota et al. |
| 2010/0075245 | A1 | 3/2010 | Watanabe et al. |
| 2010/0081075 | A1 | 4/2010 | Watanabe et al. |
| 2010/0124715 | A1 | 5/2010 | Nakazawa et al. |
| 2010/0129748 | A1 | 5/2010 | Inoue et al. |
| 2010/0310980 | A1 | 12/2010 | Sugimoto et al. |
| 2011/0033794 | A1 | 2/2011 | Watanabe et al. |
| 2011/0076607 | A1 | 3/2011 | Sugimoto et al. |
| 2011/0076610 | A1 | 3/2011 | Ogawa et al. |
| 2011/0076612 | A1 | 3/2011 | Awamura et al. |
| 2011/0086308 | A1 | 4/2011 | Watanabe et al. |
| 2011/0129773 | A1 | 6/2011 | Shu et al. |
| 2011/0223532 | A1 | 9/2011 | Sugimoto et al. |
| 2011/0262856 | A1 | 10/2011 | Sugimoto et al. |
| 2012/0052431 | A1 | 3/2012 | Hozumi et al. |

FOREIGN PATENT DOCUMENTS

| | | |
|---|---|---|
| JP | 2006-106699 | 4/2006 |
| JP | 2006-208609 | 8/2006 |
| JP | 2006-235028 | 9/2006 |
| JP | 2006-276855 | 10/2006 |
| JP | 2006-293338 | 10/2006 |
| JP | 2006-337872 | 12/2006 |
| JP | 2007-025525 | 2/2007 |
| JP | 2007-034280 | 2/2007 |
| JP | 2007-058117 | 3/2007 |
| JP | 2007-072333 | 3/2007 |
| JP | 2007-233169 | 9/2007 |
| JP | 2009-069862 | 4/2009 |
| JP | 2009-109971 | 5/2009 |
| JP | 2010-122370 | 6/2010 |

TONER AND METHOD FOR PRODUCING THE SAME

TECHNICAL FIELD

The present invention relates to a toner, a method for producing the toner, a developer and an image forming apparatus.

BACKGROUND ART

Image formation in, for example, electrophotography, electrostatic recording and electrostatic printing is generally performed in accordance with a series of steps: forming a latent electrostatic image on a photoconductor; developing the latent electrostatic image with a developer to form a toner image; transferring the toner image onto a recording medium such as paper; and fixing the transferred image on the recording medium.

The developer is mainly classified into a one-component developer containing only a magnetic or non-magnetic toner and a two-component developer containing a toner and a carrier.

The toner used in the developer has been required to have low-temperature fixability and heat resistant storage stability. It has been known to use polyester as a binder resin of the toner.

However, in order to achieve high-speed processing and energy saving of image forming apparatuses, the fixing time at a fixing step has been shortened and the heating temperature with a fixing unit has been lowered. As a result, it becomes difficult to maintain sufficient fixing strength.

PTL 1 discloses a toner including: toner base particles each containing a binder resin and wax; and an external additive, wherein the binder resin contains a crystalline polyester. Here, the calorie of an area surrounded by an endothermic curve of this toner determined with a differential scanning calorimeter and by a straight line connecting the top of an endothermic peak appearing at the lowest temperature among endothermic peaks attributed to the binder resin with the top of an endothermic peak attributed to the wax having the lowest melting point among the waxes is 0.1 J/g to 10.0 J/g. Also, the toner has an average circularity of 0.940 to 0.980, and the amount of particles having a particle diameter of smaller than 3 μm is equal to or less than 5% by number.

PTL 2 discloses a method for producing an electrostatic image developing toner including a step of storing an intermediate or final product of a toner at 45° C. to 65° C., wherein the toner contains a colorant and binder resins, and at least one of the binder resins is polyester resin (A) having crystallinity.

However, there has still been a problem that a favorable balance between low-temperature fixability and heat resistant storage stability cannot be achieved in the toner.

CITATION LIST

Patent Literature

PTL 1: Japanese Patent Application Laid-Open (JP-A) No. 2009-109971

PTL 2: JP-A No. 2006-065015

SUMMARY OF INVENTION

Technical Problem

In view of the above problems pertinent in the art, an object of the present invention is to provide a toner excellent in low-temperature fixability and heat resistant storage stability and a method for producing the toner. Also, another object of the present invention is to provide a developer containing the toner and an image forming apparatus using the developer.

Solution to Problem

A toner of the present invention includes base particles each containing a crystalline polyester and a non-crystalline polyester, wherein the toner has a glass transition temperature of 45° C. or higher where the glass transition temperature is determined from a DSC curve of the toner obtained in the first elevation of temperature thereof, and wherein the toner has a temperature width of 8° C. or lower where the temperature width is a temperature width at ⅓ the height of an endothermic peak in the DSC curve.

A method of the present invention for producing a toner includes: dissolving or dispersing a crystalline polyester and a non-crystalline polyester in an organic solvent having a temperature of 30° C. or lower, to thereby prepare a first liquid; mixing the first liquid with materials containing a colorant and a releasing agent, to thereby prepare a second liquid; emulsifying or dispersing the second liquid in an aqueous medium, to thereby prepare a third liquid; and removing the organic solvent from the third liquid, wherein the crystalline polyester has a melting point of 60° C. to 80° C. where the melting point is determined from a DSC curve of the crystalline polyester obtained in the first elevation of temperature thereof, and wherein the non-crystalline polyester has a glass transition temperature of 45° C. to 65° C. where the glass transition temperature is determined from a DSC curve of the non-crystalline polyester obtained in the first elevation of temperature thereof.

A method of the present invention for producing a toner includes: kneading materials containing a crystalline polyester, a non-crystalline polyester, a colorant and a releasing agent at a temperature of 100° C. or lower; pulverizing the kneaded material; classifying the pulverized material; and annealing the classified material for 48 hours or longer at a temperature falling within a range of an onset temperature ±5° C. where the onset temperature is determined from a DSC curve of the crystalline polyester obtained in the first elevation of temperature thereof, wherein the crystalline polyester has a melting point of 60° C. to 80° C. where the melting point is determined from the DSC curve of the crystalline polyester obtained in the first elevation of temperature thereof, and wherein the non-crystalline polyester has a glass transition temperature of 45° C. to 65° C. where the glass transition temperature is determined from a DSC curve of the non-crystalline polyester obtained in the first elevation of temperature thereof.

A method of the present invention for producing a toner includes: emulsifying or dispersing a crystalline polyester in an aqueous medium to prepare a first liquid; emulsifying or dispersing a non-crystalline polyester in an aqueous medium to prepare a second liquid; emulsifying or dispersing a colorant in an aqueous medium to prepare a third liquid; emulsifying or dispersing a releasing agent in an aqueous medium to prepare a fourth liquid; mixing together the first liquid, the second liquid, the third liquid and the fourth liquid to aggregate particles, to thereby prepare a liquid containing aggregated particles; heating the liquid containing the aggregated particles to a temperature that is equal to or higher than a melting point of the crystalline polyester and is equal to or higher than a glass transition temperature of the non-crystalline polyester, to thereby fuse the aggregated particles with each other, where the melting point of the crystalline polyester is determined from a DSC curve of the crystalline polyester obtained in the first elevation of temperature thereof and the glass transition temperature of the non-crystalline polyester is determined from a DSC curve of the non-crystalline polyester obtained in the first elevation of temperature thereof, and annealing the fused particles for 48 hours or longer at a temperature falling within a range of an onset temperature ±5° C., where the onset temperature is determined from a DSC curve of the crystalline polyester obtained in the first elevation of temperature thereof, wherein the crystalline polyester has a melting point of 60° C. to 80° C. where the melting point is determined from a DSC curve of the crystalline polyester obtained in the first elevation of temperature thereof, and wherein the non-crystalline polyester has a glass transition temperature of 45° C. to 65° C. where the glass transition temperature is determined from a DSC curve of the non-crystalline polyester obtained in the first elevation of temperature thereof.

A developer of the present invention includes the toner of the present invention.

An image forming apparatus of the present invention includes: a charging unit configured to charge a photoconductor, an exposing unit configured to expose the charged photoconductor to light to form a latent electrostatic image; a developing unit configured to develop the latent electrostatic image formed on the photoconductor with the developer of the present invention to form a toner image; a transfer unit configured to transfer the toner image formed on the photoconductor onto a recording medium; and a fixing unit configured to fix the transferred toner image on the recording medium.

Advantageous Effects of Invention

The present invention can provide a toner excellent in low-temperature fixability and heat resistant storage stability and a method for producing the toner. Also, the present invention can provide a developer containing the toner and an image forming apparatus using the developer.

DESCRIPTION OF EMBODIMENTS

Figure 1:
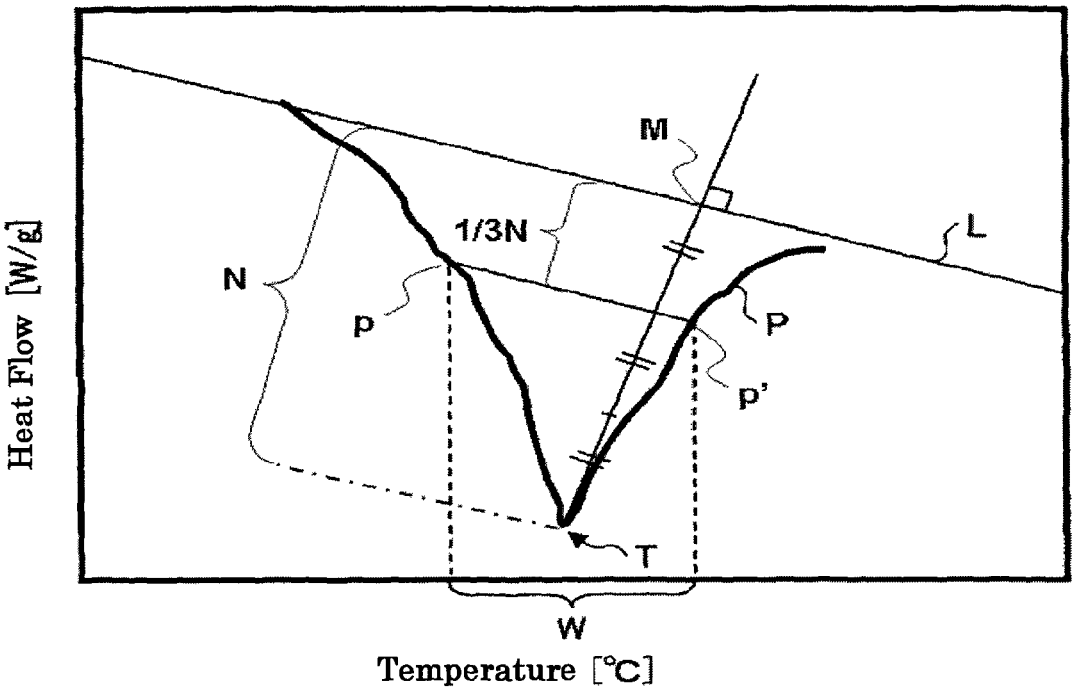
FIG. 1 is a graph of one exemplary DSC curve of a toner of the present invention in the first elevation of temperature.

Referring to the drawings, next will be described modes for carrying out the present invention.

(Toner)

A toner of the present invention includes at least base particles each containing a crystalline polyester and a non-crystalline polyester; preferably further includes a urea-modified polyester, a colorant and a releasing agent. If necessary, the toner of the present invention further includes other ingredients.

The toner of the present invention preferably has a glass transition temperature of 45° C. to 65° C. where the glass transition temperature is determined from a DSC curve of the toner obtained in the first elevation of temperature thereof. When the glass transition temperature determined from the DSC curve of the toner obtained in the first elevation of temperature thereof is lower than 45° C., the formed toner decreases in heat resistant storage stability.

The toner of the present invention has a temperature width W of 8° C. or lower, preferably 5° C. or lower, where the temperature width W is a temperature width at ⅓ the height of an endothermic peak in a DSC curve of the toner obtained in the first elevation of temperature thereof (see FIG. 1). When the temperature width W exceeds 8° C., the crystalline polyester and the non-crystalline polyester are compatible together, resulting in that the formed toner is degraded in heat resistant storage stability. Notably, presumably, the endothermic peak is attributed to the crystalline polyester in the toner.

The temperature width W is defined as follows. In the DSC curve of the first elevation of temperature shown in FIG. 1, baseline L is defined as a line connecting the point of the DSC curve at 0° C. with the point of the DSC curve at 140° C. Next, a vertical line is drawn from the top T of the endothermic peak P to the baseline L so that the vertical line is perpendicular to the baseline L. Here, the intersection point between the vertical line and the baseline L is defined as intersection point M.

Next, in the thus-defined vertical line, a height (⅓N) corresponding to a point distant from the baseline L by ⅓ the height N of the endothermic peak from the intersection point M to the top T is determined. Next, a line in parallel with the baseline L is drawn at the height of ⅓N. A traverse width (temperature) obtained by taking the endothermic peak P along the line in parallel with the baseline L drawn at the height of ⅓N is defined as the temperature width W.

The traverse width (temperature) is the length of a line connecting two intersection points p and p' with each other, where the two intersection points p and p' denotes intersection points formed between the endothermic peak P and the line in parallel with the baseline L drawn at the height of ⅓N in the endothermic peak. In other words, a width of temperature in the region between the intersection points p and p' is defined as the temperature width W.

The temperature width W is generally 0° C. or higher.

Notably, the DSC curve of the toner can be measured with a thermal analyzer Q200 (product of TA INSTRUMENTS Co.).

As described below, the toner of the present invention can be produced with the method of the present invention for producing a toner.

The toner of the present invention preferably has a ½ effluent temperature of 110° C. to 140° C., more preferably 110° C. to 125° C. When the ½ effluent temperature of the toner of the present invention is lower than 110° C., the toner may be degraded in hot offset resistance. Whereas when it exceeds 140° C., the toner may be degraded in low-temperature fixability.

Notably, the ½ effluent temperature of the toner can be measured with an elevation-type flow tester model CFT500 (product of Shimadzu Corporation).

<Crystalline Polyester>

The crystalline polyester preferably has a melting point of 60° C. to 80° C., preferably 65° C. to 70° C., where the melting point is determined from a DSC curve of the crystalline polyester obtained in the first elevation of temperature thereof. When the melting point determined from the DSC curve of the crystalline polyester obtained in the first elevation of temperature thereof is lower than 60° C., the formed toner may be degraded in heat resistant storage stability. Whereas when it exceeds 80° C., the formed toner may be degraded in low-temperature fixability.

Notably, the DSC curve of the crystalline polyester can be measured with a differential scanning calorimeter DSC-60 (product of Shimadzu Corporation).

The crystalline polyester can be obtained through dehydration condensation between a diol and a dicarboxylic acid.

The diol is not particularly limited, and examples thereof include C2-C12 alkylene glycols such as 1,4-butanediol, 1,6-hexanediol, 1,8-octanediol, 1,10-decanediol and 1,12-dodecanediol. These may be used alone or in combination. In particular, one type of C2-C12 alkylene glycol is preferably used alone since the formed crystalline polyester is increased in crystallinity and thus sharply decreased in viscosity around the melting point thereof.

The dicarboxylic acid is not particularly limited, and examples thereof include C2-C12 alkenylene dicarboxylic acids such as fumaric acid, and C2-C12 alkylene dicarboxylic acids such as 1,4-butanedioic acid, 1,6-hexanedioic acid, 1,8-octanedioic acid, 1,10-decanedioic acid and 1,12-dodecanedioic acid. These may be used alone or in combination. In particular, one type of C2-C12 alkylene dicarboxylic acid is preferably used alone since the formed crystalline polyester is increased in crystallinity and thus sharply decreased in viscosity around the melting point thereof.

<Non-Crystalline Polyester>

The non-crystalline polyester preferably has a glass transition temperature of 45° C. to 65° C., preferably 45° C. to 55° C., where the glass transition temperature is determined from a DSC curve obtained in the first elevation of temperature. When the glass transition temperature determined from the DSC curve of the non-crystalline polyester obtained in the first elevation of temperature thereof is lower than 45° C., the formed toner may be degraded in heat resistant storage stability. Whereas when it exceeds 65° C., the formed toner may be degraded in low-temperature fixability.

Notably, the DSC curve of the non-crystalline polyester can be measured with a differential scanning calorimeter DSC-60 (product of Shimadzu Corporation).

The non-crystalline polyester can be obtained through dehydration condensation between a polyhydric alcohol and a polycarboxylic acid.

The polyhydric alcohol is not particularly limited, and examples thereof include dihydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and adducts of bisphenol A with an alkylene oxide such as ethylene oxide or propylene oxide; and tri- or higher hydric alcohols (each having three or more hydroxyl groups) such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene. These may be used alone or in combination.

The polycarboxylic acid is not particularly limited, and examples thereof include benzenedicarboxylic acids such as phthalic acid, isophthalic acid and terephthalic acid; alkanedicarboxylic acids such as succinic acid, adipic acid, sebacic acid and azelaic acid; unsaturated dibasic acids such as maleic acid, citraconic acid, itaconic acid, alkenylsuccinic acid, fumaric acid and mesaconic acid; and tri- or higher valent carboxylic acids (each having three or more carboxyl group) such as trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-haxanetricarboxylic acid, 1,3-dicarboxyl-2-methyl-2-methylenecarboxypropane, tetrakis(methylenecarboxy) methane, 1,2,7,8-octanetetracarboxylic acid and Enpol trimer acid. These may be used alone or in combination.

Instead of the polycarboxylic acid(s), an anhydride(s), a lower alkyl ester(s), etc. of the polycarboxylic acid(s) may be used.

The acid value of the non-crystalline polyester is generally 5 mgKOH/g to 40 mgKOH/g, preferably 10 mgKOH/g to 30 mgKOH/g. When the acid value of the non-crystalline polyester is lower than 5 mgKOH/g, the formed toner decreases in affinity for paper, resulting in that it may be degraded in low-temperature fixability. Whereas when the acid value of the non-crystalline polyester exceeds 40 mgKOH/g, the formed toner becomes susceptible to environmental factors under high-temperature, high-humidity conditions or low-temperature, low-humidity conditions, resulting in that the formed image may be degraded in image quality.

Notably, the acid value can be measured according to the method described in JIS K0070-1992.

The hydroxyl value of the non-crystalline polyester is generally 5 mgKOH/g to 100 mgKOH/g, preferably 20 mgKOH/g to 60 mgKOH/g. When the hydroxyl value of the non-crystalline polyester is lower than 5 mgKOH/g, the formed toner decreases in affinity for paper, resulting in that it may be degraded in low-temperature fixability. Whereas when the hydroxyl value of the non-crystalline polyester exceeds 100 mgKOH/g, the formed toner becomes susceptible to environmental factors under high-temperature, high-humidity conditions or low-temperature, low-humidity conditions, resulting in that the formed image may be degraded in image quality.

Notably, the hydroxyl value can be measured according to the method described in JIS K0070-1966.

Also, in a molecular weight distribution of THF soluble matter of the non-crystalline polyester, the non-crystalline polyester generally has a peak within a range of $3\times10^3$ to $5\times10^4$ in weight average molecular weight, preferably has a peak within a range of $5\times10^3$ to $2\times10^4$ in weight average molecular weight, from the viewpoints of fixability and offset resistance of the formed toner.

In addition, the THF soluble matter having a weight average molecular weight of $1\times10^6$ or lower is generally contained in the non-crystalline polyester in an amount of 60% by mass to 100% by mass.

Notably, the molecular distribution of the non-crystalline polyester can be measured through gel permeation chromatography (GPC) using THF as a developing solvent.

<Urea-Modified Polyester>

Preferably, the base particles each further contain a urea-modified polyester. Incorporation of the urea-modified polyester into each base particle can improve the formed toner in low-temperature fixability and heat resistant storage stability.

The urea-modified polyester can be synthesized through reaction between an isocyanate group-containing polyester prepolymer and an amino group-containing compound. The isocyanate group-containing polyester prepolymer can be synthesized between a hydroxyl group-containing polyester and a polyisocyante.

The hydroxyl group-containing polyester can be obtained through dehydration condensation between a polyhydric alcohol and a polycarboxylic acid.

The polyhydric alcohol is not particularly limited, and examples thereof include dihydric alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and adducts of bisphenol A with an alkylene oxide such as ethylene oxide or propylene oxide; and tri- or higher hydric alcohols (each having three or more hydroxyl groups) such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene. These may be used alone or in combination.

The polycarboxylic acid is not particularly limited, and examples thereof include benzenedicarboxylic acids such as phthalic acid, isophthalic acid and terephthalic acid; alkanedicarboxylic acids such as succinic acid, adipic acid, sebacic acid and azelaic acid; unsaturated dibasic acids such as maleic acid, citraconic acid, itaconic acid, alkenylsuccinic acid, fumaric acid and mesaconic acid; and tri- or higher valent carboxylic acids (each having three or more carboxyl group) such as trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-haxanetricarboxylic acid, 1,3-dicarboxyl-2-methyl-2-methylenecarboxypropane, tetrakis(methylenecarboxy) methane, 1,2,7,8-octanetetracarboxylic acid and Enpol trimer acid. These may be used alone or in combination.

Instead of the polycarboxylic acid(s), an anhydride(s), a lower alkyl ester(s), etc. of the polycarboxylic acid(s) may be used.

The polyisocyante is not particularly limited, and examples thereof include aliphatic polyisocyanates such as tetramethylene diisocyanate, hexamethylene diisocyanate and 2,6-diisocyanatomethylcaproate; alicyclic polyisocyanates such as isophorone diisocyanate and cyclohexylmethane diisocyanate; aromatic diisocyanates such as tolylene diisocyanate and diphenylmethane diisocyanate; aroma-aliphatic diisocyanates such as $\alpha,\alpha,\alpha',\alpha'$-tetramethylxylylene diisocyanate; and isocyanates. These may be used alone or in combination.

Instead of the polyisocyante(s), there can be used compound(s) obtained by blocking the isocyanate group of the above-listed polyisocyanate(s) with a phenol derivative, an oxime, a caprolactam, etc.

In the reaction between the hydroxyl group-containing polyester and the polyisocyante, the equivalent ratio of the isocyanate group of the polyisocyante to the hydroxyl group of the hydroxyl group-containing polyester (isocyanate group/hydroxyl group) is generally 1 to 5, preferably 1.2 to 4, more preferably 1.5 to 2.5.

The number of the isocyanate groups in the isocyanate group-containing polyester prepolymer is generally 1 or more per molecule, preferably 1.5 to 3, more preferably 1.8 to 2.5.

Examples of the amino group-containing compound include divalent amines, tri- or higher valent amines, aminoalcohols, aminomercaptans and amino acids.

The divalent amine is not particularly limited, and examples thereof include aromatic diamines such as phenylenediamine, diethyltoluenediamine and 4,4'-diaminodiphenylmethane; alicyclic diamines such as 4,4'-diamino-3,3'-dimethyldicyclohexylmethane, diaminocyclohexane and isophoronediamine; and aliphatic diamines such as ethylenediamine, tetramethylenediamine and hexamethylenediamine.

The tri- or higher valent amine is not particularly limited, and examples thereof include diethylenetriamine and triethylenetetramine.

The aminoalcohol is not particularly limited, and examples thereof include ethanolamine and hydroxyethylaniline.

The aminomercaptan is not particularly limited, and examples thereof include aminoethyl mercaptan and aminopropyl mercaptan.

The amino acid is not particularly limited, and examples thereof include aminopropionic acid and aminocaproic acid.

Instead of the amino group-containing compound(s), there can be used oxazolidines and ketimines obtained by blocking the amino group of the amino group-containing compound(s) with a ketone such as acetone, methyl ethyl ketone or methyl isobutyl ketone.

In the reaction between the isocyanate group-containing polyester prepolymer and the amino group-containing compound, the equivalent ratio of the isocyanate group of the isocyanate group-containing polyester prepolymer to the amino group of the amino group-containing compound (isocyanate group/amino group) is generally 0.5 to 2, preferably ⅔ to 1.5, more preferably ⅚ to 1.2.

<Other Resins>

The base particles may each further contain other resin(s) than the crystalline polyester and the non-crystalline polyester. The other resins are not particularly limited, and examples thereof include homopolymers or copolymers formed of, for example, styrene monomers, acrylic monomers and/or methacrylic monomers; polyol resins; phenol resins; silicone resins; polyurethanes; polyamides; furan resins; epoxy resins; xylene resins; terpene resin; coumarone-indene resins; polycarbonates; and petroleum resins. These may be used alone or in combination.

<Colorant>

The toner of the present invention preferably further contains a colorant.

The colorant is not particularly limited so long as it is a dye or pigment. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower and lithopone. These may be used alone or in combination.

The amount of the colorant contained in the toner is generally 1% by mass to 15% by mass, preferably 3% by mass to 10% by mass. When the amount of the colorant contained in the toner is less than 1% by mass, the formed toner may be degraded in coloring performance. Whereas when the amount thereof is more than 15% by mass, the colorant is not sufficiently dispersed in the toner, potentially leading to a drop in coloring performance and degradation in electrical characteristics of the formed toner.

The colorant may be mixed with a resin to form a masterbatch.

The resin used in the masterbatch is not particularly limited, and examples thereof include polyesters, styrene homopolymers, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyrals, polyacrylic acid resins, rosin, modified rosins, terpene resins, aliphatic or alicyclic hydrocarbon resins, aromatic petroleum resins, chlorinated paraffins and paraffin waxes. These may be used alone or in combination.

Examples of the styrene homopolymers include polystyrenes, poly(p-chlorostyrenes) and polyvinyltoluenes.

Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatch can be produced by mixing or kneading the colorant with the resin using a high-shearing dispersing apparatus such as a three-roll mill. Preferably, an organic solvent may be added to the masterbatch for improving interactions between the colorant and the resin. Furthermore, the flashing method is preferably employed for producing the masterbatch, since a wet cake of the colorant can be directly used; i.e., no drying is required. The flashing method is a method in which an aqueous paste containing a colorant is mixed or kneaded with a resin and an organic solvent and then the colorant is transferred to the resin to remove water and the organic solvent.

<Releasing Agent>

The toner of the present invention preferably further contains a releasing agent.

The releasing agent is not particularly limited, and examples thereof include vegetable waxes such as carnauba wax, cotton wax, Japan wax and rice wax; animal waxes such as bees wax and lanolin; mineral waxes such as ozokelite and ceresine; hydrocarbon waxes such as paraffin waxes, microcrystalline waxes, Fischer-Tropsch waxes, polyethylene waxes and polypropylene waxes; and synthetic waxes such as ester waxes, ketone waxes and ether waxes. These may be used alone or in combination. Among them, hydrocarbon waxes are preferred.

The releasing agent preferably has a melting point of 60° C. to 90° C. When the melting point of the releasing agent is lower than 60° C., the formed toner may be degraded in heat resistant storage stability. Whereas when the melting point of the releasing agent is higher than 90° C., the formed toner may be degraded in offset resistance.

The amount of the releasing agent contained in the toner is generally 2% by mass to 10% by mass, preferably 3% by mass to 8% by mass. When the amount of the releasing agent contained in the toner is less than 2% by mass, the formed toner may be degraded in offset resistance. Whereas when the amount thereof is higher than 10% by mass, the formed toner may be degraded in heat resistant storage stability.

<Other Ingredients>

The toner of the present invention may further contain other ingredients such as a charge controlling agent, a flowability improving agent, a cleanability improving agent and a magnetic material.

—Charge Controlling Agent—

The charge controlling agent is not particularly limited, and examples thereof include nigrosine dyes, triphenylmethane dyes, chrome-containing metal complex dyes, molybdenum acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-containing surfactants, metal salts of salicylic acid, and metal salts of salicylic acid derivatives. These may be used alone or in combination.

Also, examples of commercially available products of the charge controlling agent include BONTRON 03 (nigrosine dye), BONTRON P-51 (quaternary ammonium salt), BONTRON S-34 (metal-containing azo dye), E-82 (oxynaphthoic acid-based metal complex), E-84 (salicylic acid-based metal complex) and E-89 (phenol condensate) (these products are of Orient Chemical Industries, Ltd.); TP-302 and TP-415 (quaternary ammonium salt molybdenum complex (these products are of Hodogaya Chemical Co.); COPY CHARGE PSY VP 2038 (quaternary ammonium salt), COPY BLUE PR (triphenylmethane derivative), COPY CHARGE NEG VP2036 (quaternary ammonium salt) and COPY CHARGE NX VP434 (these products are of Hoechst AG); LRA-901 and LR-147 (boron complex) (these products are of Japan Carlit Co., Ltd.); copper phthalocyanine; perylene; quinacridone; azo pigments; and polymeric compounds having, as a functional group, a sulfonic acid group, carboxyl group, quaternary ammonium salt, etc.

The amount of the charge controlling agent contained in the base particles is generally 0.1% by mass to 10% by mass, preferably 0.2% by mass to 5% by mass, with respect to the amount of the resin contained in the base particles. When the amount thereof is less than 0.1% by mass, the chargeability of the formed toner may become insufficient. Whereas when the amount thereof is more than 10% by mass, the electrostatic force increases between the formed toner and the developing roller, resulting in that the toner may be degraded in flowability and also the image formed with the toner may be degraded in image density.

—Flowability Improving Agent—

The average primary particle diameter of the flowability improving agent is generally 5 nm to 2 μm, preferably 5 nm to 500 nm.

The material of the flowability improving agent is not particularly limited, and examples thereof include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. These may be used alone or in combination.

The amount of the flowability improving agent contained in the toner is generally 0.01% by mass to 5.0% by mass, preferably 0.01% by mass to 2.0% by mass.

Also, the flowability improving agent is preferably subjected to a surface treatment using a surface treatment agent. The surface treatment increases the hydrophobicity of the flowability improving agent and as a result, the formed toner can be prevented from being degraded in flowability under high-humidity conditions.

The surface treatment agent is not particularly limited, and examples thereof include silane coupling agents, silylating agents, fluorinated alkyl group-containing silane coupling agents, organic titanate-based coupling agents, aluminum-based coupling agents, silicone oil and modified silicone oil.

—Cleanability Improving Agent—

The cleanability improving agent is not particularly limited, and examples thereof include fatty acid metal salts such as zinc stearate and calcium stearate; and resin particles synthesized through soap-free emulsification polymerization such as polymethyl methacrylate particles and polystyrene particles.

In general, the resin particles have a volume average particle diameter of 0.01 μm to 1 μm.

—Magnetic Material—

The magnetic material is not particularly limited, and examples include iron, magnetite and ferrite. Notably, the magnetic material is preferably white in consideration of the color tone of the formed toner.

(Method for Producing a Toner)

A method for producing a toner is, for example, a method according to a first embodiment, a method according to a second embodiment and a method according to a third embodiment, which are described below.

First Embodiment

According to a first embodiment of the method of the present invention for producing a toner, the method includes: dissolving or dispersing a crystalline polyester and a non-crystalline polyester in an organic solvent, to thereby prepare a first liquid; mixing the first liquid with a toner material containing a colorant and a releasing agent, to thereby prepare a second liquid; emulsifying or dispersing the second liquid in an aqueous medium, to thereby prepare a third liquid; and removing the organic solvent from the third liquid to form base particles. Here, the toner material may further contain an isocyanate group-containing polyester prepolymer and an amino group-containing compound.

The temperature of the organic solvent is preferably 30° C. or lower. When the temperature of the organic solvent exceeds 30° C., the crystalline polyester and the non-crystalline polyester are compatible together. The formed toner has a temperature width W (see FIG. 1) exceeding 8° C. where the temperature width W is a temperature width at ⅓ the height of an endothermic peak in a DSC curve of the toner obtained in the first elevation of temperature thereof. As a result, the toner is degraded in heat resistant storage stability. Here, the temperature of the organic solvent is preferably 0° C. or higher.

Since the non-crystalline polyester is used together with the crystalline polyester for preparing the first liquid, the first liquid can be lowered in viscosity.

The organic solvent is not particularly limited, and examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. Of these, preferred are toluene, xylene, methylene chloride, 1,2-dichloroethane, chloroform, carbon tetrachloride, etc.

The amount of the organic solvent used is generally 40 parts by mass to 300 parts by mass, preferably 60 parts by mass to 140 parts by mass, more preferably 80 parts by mass to 120 parts by mass, per 100 parts by mass of the total amount of the crystalline polyester and the non-crystalline polyester.

Notably, prior to mixing the first liquid with the toner material, the ingredients contained in the toner material may be dissolved or dispersed in the organic solvent, if necessary.

In another alternative manner, instead of preparing the second liquid, parts of the toner material are dissolved or dispersed in the organic solvent to prepare several liquids, which are mixed when the first liquid is emulsified or dispersed in the aqueous medium.

Furthermore, the toner-forming materials other than the resin may be added after the base particles have been formed. For example, the base particles containing no colorant may be formed and then dyed.

The ratio by mass of the isocyanate group-containing polyester prepolymer to the non-crystalline polyester (polyester prepolymer/non-crystalline polyester) is generally 5/95 to 25/75, preferably 10/90 to 25/75. When the ratio by mass thereof is less than 5/95, the formed toner may be degraded in hot offset resistance. Whereas when the ratio by mass thereof is more than 25/75, the formed toner may be degraded in low-temperature fixability and also the formed image may be degraded in glossiness.

The time for which the isocyanate group-containing polyester prepolymer and the amino group-containing compound are reacted together is generally 10 min to 40 hours, preferably 2 hours to 24 hours. The temperature at which the isocyanate group-containing polyester prepolymer and the amino group-containing compound are reacted together is generally 0° C. to 150° C., preferably 40° C. to 98° C.

Notably, in the reaction between the isocyanate group-containing polyester prepolymer and the amino group-containing compound, a catalyst such as dibutyltinlaurate or dioctyltinlaurate may be used.

The aqueous medium usable is water or a solvent mixture of a water-miscible organic solvent and water.

Examples of the water-miscible organic solvent include alcohols such as methanol, isopropanol and ethylene glycol; cellosolves such as dimethylformamide, tetrahydrofuran and methyl cellosolve; and lower ketone such as acetone and methyl ethyl ketone. These may be used alone or in combination.

The amount of the aqueous medium used is generally 50 parts by mass to 2,000 parts by mass, preferably 100 parts by mass to 1,000 parts by mass, per 100 parts by mass of the materials forming the base particles. When the amount of the aqueous medium used is less than 50 parts by mass per 100 parts by mass of the materials forming the base particles, the materials forming the base particles are poorly dispersed, resulting in that the particle diameter of the base particles may be large. Whereas, it is not economical to use the aqueous medium in an amount more than 2,000 parts by mass per 100 parts by mass of the materials forming the base particles.

The dispersing apparatus used for emulsifying or dispersing the second liquid in the aqueous medium is not particularly limited, and examples thereof include a low-speed shearing dispersing apparatus, a high-speed shearing dispersing apparatus, a friction dispersing apparatus, a high-pressure jetting dispersing apparatus and an ultrasonic dispersing apparatus. Of these, a high-speed shearing dispersing apparatus is preferably used since the particle diameter of the dispersoids (oil droplets) of the second liquid can be controlled to be 2 μm to 20 μm.

The rotation speed of the high-speed shearing dispersing apparatus is generally 1,000 rpm to 30,000 rpm, preferably 5,000 rpm to 20,000 rpm. The dispersion time is generally 0.1 min to 5 min when a batch method is employed. The temperature during dispersion is generally 0° C. to 150° C. (in a pressurized state), preferably from 40° C. to 98° C.

The aqueous medium preferably contains a dispersing agent.

The dispersing agent is not particularly limited, and examples thereof include anionic surfactants such as alkylbenzenesulfonic acid salts, α-olefin sulfonic acid salts and phosphoric acid esters; amine salt-type cationic surfactants such as alkyl amine salts, aminoalcohol fatty acid derivatives, polyamine fatty acid derivatives and imidazoline; quaternary ammonium salt-type cationic surfactants such as alkyltrimethylammonium salts, dialkyl dimethylammonium salts, alkyl dimethyl benzyl ammonium salts, pyridinium salts, alkyl isoquinolinium salts and benzethonium chloride; nonionic surfactants such as fatty acid amide derivatives and polyhydric alcohol derivatives; and amphoteric surfactants such as alanine, dodecylbis(aminoethyl)glycine, bis(octylaminoethyl)glycine and N-alkyl-N,N-dimethylammonium betaine. Of these, preferred are fluoroalkyl group-containing anionic surfactants and fluoroalkyl group-containing cationic surfactants.

The fluoroalkyl group-containing anionic surfactant is not particularly limited, and examples thereof include C2 to C10 fluoroalkyl carboxylic acids and metal salts thereof, disodium perfluorooctanesulfonylglutamate, sodium 3-[ω-fluoroalkyl (C6 to C11)oxy)-1-alkyl(C3 or C4) sulfonates, sodium 3-[ω-fluoroalkanoyl(C6 to C8)-N-ethylamino]-1-propanesulfonates, fluoroalkyl(C11 to C20) carboxylic acids and metal salts thereof, perfluoroalkylcarboxylic acids (C7 to C13) and metal salts thereof, perfluoroalkyl(C4 to C12)sulfonate and metal salts thereof, perfluorooctanesulfonic acid diethanol amide, N-propyl-N-(2-hydroxyethyl)perfluorooctanesulfone amide, perfluoroalkyl(C6 to C10)sulfoneamidepropyltrimethylammonium salts, salts of perfluoroalkyl (C6 to C10)-N-ethylsulfonylglycin and monoperfluoroalkyl (C6 to C16)ethylphosphates.

Examples of commercially available products of the fluoroalkyl group-containing anionic surfactant include SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (these products are of DIC, Inc.); EFTOP EF-102, 103, 104, 105, 112, 123A, 123B, 306A, 501, 201 and 204 (these products are of Tohchem Products Co., Ltd.); and FUTARGENT F-100 and F150 (these products are of NEOS COMPANY LIMITED).

The fluoroalkyl group-containing cationic surfactant is not particularly limited, and examples thereof include fluoroalkyl group-containing primary, secondary or tertiary aliphatic amine acids, aliphatic quaternary ammonium salts (e.g., perfluoroalkyl(C6 to C10)sulfoneamide propyltrimethylammonium salts), benzalkonium salts, benzetonium chloride, pyridinium salts and imidazolinium salts.

Examples of commercially available products of the fluoroalkyl group-containing cationic surfactant include SURFLON S-121 (product of Asahi Glass Co., Ltd.); FRORARD FC-135 (product of Sumitomo 3M Ltd.); UNIDYNE DS-202 (product of Daikin Industries, Ltd.); MEGAFACE F-150 and F-824 (these products are of DIC, Inc.); EFTOP EF-132 (product of Tohchem Products Co., Ltd.); and FUTARGENT F-300 (product of Neos COMPANY LIMITED).

The dispersing agent may be poorly water-soluble inorganic compounds or resin particles.

In addition, the poorly water-soluble inorganic compound is not particularly limited, and examples thereof include tricalcium phosphate, calcium carbonate, titanium oxide, colloidal silica and hydroxyapatite.

The material of the resin particles is not particularly limited, and examples thereof include polymethyl methacrylates, polystyrens and styrene-acrylonitrile copolymers.

Examples of commercially available products of the resin particles include PB-200H (product of Kao Corporation), SGP (product of Soken Chemical & Engineering Co., Ltd.), TECHNO POLYMER SB (product of Sekisui Plastics Co., Ltd.), SGP-3G (product of Soken Chemical & Engineering Co., Ltd.) and MICROPEARL (product of SEKISUI FINE CHEMICAL CO., LTD.).

Also, a polymeric protective colloid may be used in combination with the poorly water-soluble inorganic compounds or the resin particles.

The polymeric protective colloid is not particularly limited, and examples thereof include homopolymers and copolymers prepared using acids such as acrylic acid, methacrylic acid, α-cyanoacrylic acid, α-cyanomethacrylic acid, itaconic acid, crotonic acid, fumaric acid, maleic acid and maleic anhydride; hydroxyl group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide; ethers of vinyl alcohol such as vinyl methyl ether, vinyl ethyl ether and vinyl propyl ether; esters formed between vinyl alcohol and carboxylic acids such as vinyl acetate, vinyl propionate and vinyl butyrate; acrylamide, methacrylamide, diacetoneacrylamide and methylol compounds thereof; acid chlorides such as acrylic acid chloride and methacrylic acid chloride; and compounds containing a nitrogen-containing group such as vinyl pyridine, vinyl pyrrolidone, vinyl imidazole and ethyleneimine. Further examples of the polymeric protective colloid include polyoxyethylene resins such as polyoxyethylenes, polyoxypropylenes, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters; and celluloses such as methyl cellulose, hydroxyethyl cellulose and hydroxypropyl cellulose.

When an acid- or alkali-soluble compound such as tricalcium phosphate is used as a dispersing agent, the tricalcium phosphate used is dissolved with an acid such as hydrochloric acid, followed by washing with water, to thereby remove the tricalcium phosphate from the formed base particles. Alternatively, the tricalcium phosphate may be removed from the base particles through, for example, enzymatic decomposition.

When the aqueous medium contains the dispersing agent, the dispersing agent may be allowed to remain on the surfaces of the base particles. However, the dispersing agent is preferably removed through washing considering chargeability of the formed toner.

Examples of the method for removing the organic solvent from the third liquid include a method in which the third liquid is gradually increased in temperature so that the organic solvent is evaporated, and a method in which the third liquid is sprayed to a dry atmosphere so that the organic solvent and water are evaporated.

The dry atmosphere is not particularly limited, and uses heated gas such as air, nitrogen, carbon dioxide and combustion gas. The temperature of the heated gas is preferably equal to or higher than the boiling points of the organic solvent used and water.

The apparatus with which the third liquid is sprayed to the dry atmosphere so that the organic solvent and water are evaporated is not particularly limited, and examples thereof include a spray dryer, a belt dryer and a rotary kiln.

After the organic solvent has been removed from the third liquid, the base particles or dispersion liquid containing the base particles dispersed in the aqueous medium can be obtained.

Preferably, the base particles or the dispersion liquid containing the base particles dispersed in the aqueous medium is washed with water and then dried under vacuum. With this treatment, the dispersing agent can be removed.

If necessary, the base particles may be classified.

The method for classifying the base particles is not particularly limited, and examples thereof include a method in which fine particles are removed with, for example, a cyclone, a decanter or a centrifuge, and a method in which coarse particles are removed with a mesh.

The base particles may be mixed with a charge controlling agent, a flowability improving agent, a cleanability improving agent, etc.

The method for mixing the base particles with the charge controlling agent, flowability improving agent, cleanability improving agent, etc. is not particularly limited, and examples thereof include a method in which an impact is applied to the particles with a blade rotated at a high speed and a method in which the particles are caused to pass through a high-speed airflow for acceleration and aggregated particles or complex particles are crushed against an appropriate collision plate.

The apparatus with which the base particles are mixed with the charge controlling agent, flowability improving agent, cleanability improving agent, etc. is not particularly limited, and examples thereof include ONGMILL (product of Hosokawa Micron Corp.), an apparatus produced by modifying an I-TYPE MILL (product of Nippon Neumatic Co., Ltd.) so that the pulverizing air pressure thereof is decreased, HYBRIDIZATION SYSTEM (product of Nara Machinery Co., Ltd.), CRYPTRON SYSTEM (production of Kawasaki Heavy Industries, Ltd.) and an automatic mortar.

Second Embodiment

According to a second embodiment of the method of the present invention for producing a toner, the method includes: kneading a toner material containing a crystalline polyester, a non-crystalline polyester, a colorant and a releasing agent at a temperature of 100° C. or lower; pulverizing the kneaded toner material; classifying the pulverized toner material; and annealing the classified toner material to form base particles. Here, the temperature at which the toner material is kneaded is preferably 80° C. or higher.

When the toner material is kneaded at a temperature of 100° C. or lower, it can be kneaded with the heat load being minimal. As a result, the crystalline polyester and the non-crystalline polyester can be prevented from being compatible together.

The kneader used for kneading the toner material is not particularly limited, and examples thereof include a uniaxial or biaxial continuous kneader and batch-type kneader using a roll mill.

Examples of commercially available products of the kneader include a KTK-type biaxial extruder (product of KOBE STEEL. Ltd.), a TEM-type extruder (product of TOSHIBA MACHINE CO., LTD.), a biaxial extruder (product of KCK Co., Ltd.), a PCM-type biaxial extruder (product of IKEGAI LTD.) and a co-kneader (product of BUSS Company).

Notably, the toner-forming materials other than the resin may be added after the base particles have been formed. For example, the base particles containing no colorant may be formed and then dyed.

In pulverizing the kneaded toner material, preferably, the kneaded toner material is first roughly and then finely pulverized.

The method for pulverizing the kneaded toner material is not particularly limited, and examples thereof include a method in which the kneaded toner material is crushed against a collision plate under a jet stream for pulverization, a method in which the kneaded toner materials are crushed one another under a jet stream for pulverization, and a method in which the kneaded toner material is pulverized by passage through the gap between a mechanically rotating rotor and a stator.

The method for classifying the pulverized toner material is not particularly limited, and examples thereof include a method in which fine particles are removed with, for example, a cyclone, a decanter or a centrifuge.

Figure 2:
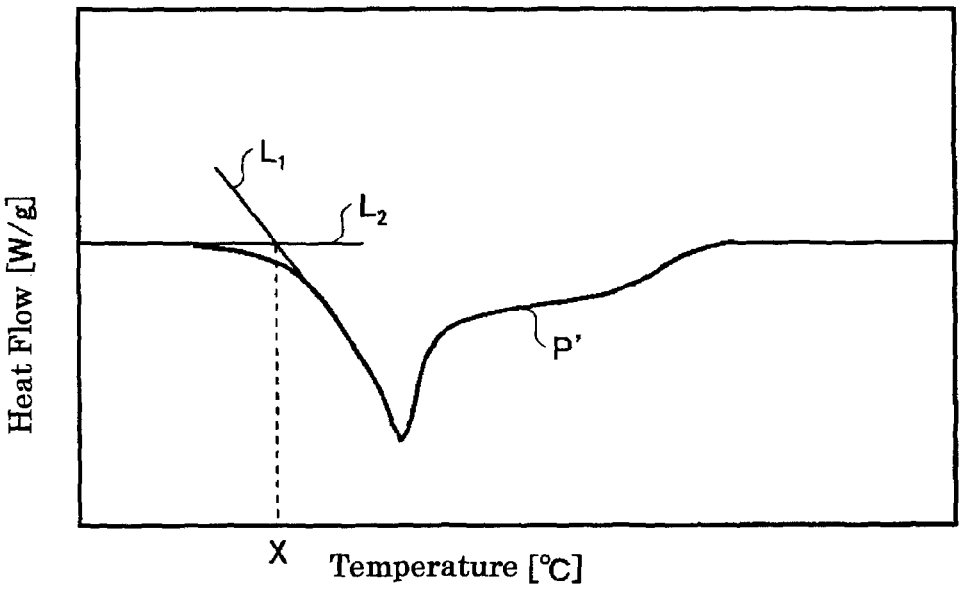
FIG. 2 is a graph of one exemplary DSC curve of a crystalline polyester in the first elevation of temperature.

The classified toner material contains the crystalline polyester and the non-crystalline polyester which have been compatible together. However, in the present embodiment, the classified toner material is annealed for 48 hours or longer at a temperature falling within a range of an onset temperature X (see FIG. 2) ±5° C. where the onset temperature X is determined from a DSC curve of the crystalline polyester in the first elevation of temperature thereof. As a result, the crystalline polyester and the non-crystalline polyester are phase-separated from each other. Here, the time for which the annealing is performed is preferably 200 hours or shorter.

When the temperature at which the annealing is performed is lower than (the onset temperature X−5° C.) or higher than (the onset temperature X+5° C.) or the time for which the annealing is performed is shorter than 48 hours, the crystalline polyester and the non-crystalline polyester are not phase-separated from each other. The formed toner has a temperature width W (see FIG. 1) exceeding 8° C. where the temperature width W is a temperature width at ⅓ the height of an endothermic peak in a DSC curve of the toner obtained in the first elevation of temperature thereof. As a result, the toner is degraded in heat resistant storage stability.

The onset temperature X is defined as follows. In the DSC curve of the first elevation of temperature shown in FIG. 2, baseline L2 is defined as a line connecting the point of the DSC curve at 0° C. with the point of the DSC curve at 140° C. Next, L1 is defined as the tangential line on the inflection point at the side where the endothermic reaction in the endothermic peak P' initiates. Then, the intersection point between the baseline L2 and the tangential line L1 is defined as the onset temperature X.

Notably, instead of annealing the classified toner material, the kneaded toner material or the pulverized toner material may be annealed.

The base particles may be mixed with a charge controlling agent, a flowability improving agent, a cleanability improving agent, etc.

The method for mixing the base particles with the charge controlling agent, flowability improving agent, cleanability improving agent, etc. is not particularly limited, and examples thereof include a method in which an impact is applied to the particles with a blade rotated at a high speed and a method in which the particles are caused to pass through a high-speed airflow for acceleration and aggregated particles or complex particles are crushed against an appropriate collision plate.

The apparatus with which the base particles are mixed with the charge controlling agent, flowability improving agent, cleanability improving agent, etc. is not particularly limited, and examples thereof include ONGMILL (product of Hosokawa Micron Corp.), an apparatus produced by modifying an I-TYPE MILL (product of Nippon Neumatic Co., Ltd.) so that the pulverizing air pressure thereof is decreased, HYBRIDIZATION SYSTEM (product of Nara Machinery Co., Ltd.), CRYPTRON SYSTEM (production of Kawasaki Heavy Industries, Ltd.) and an automatic mortar.

Third Embodiment

According to a third embodiment of the method of the present invention for producing a toner, the method includes: emulsifying or dispersing a crystalline polyester in an aqueous medium to prepare a first liquid; emulsifying or dispersing a non-crystalline polyester in an aqueous medium to prepare a second liquid; emulsifying or dispersing a colorant in an aqueous medium to prepare a third liquid; emulsifying or dispersing a releasing agent in an aqueous medium to prepare a fourth liquid; mixing together the first liquid, the second liquid, the third liquid and the fourth liquid to aggregate particles, to thereby prepare a liquid containing aggregated particles; heating the liquid containing the aggregated particles to fuse the aggregated particles with each other; and annealing the fused particles to form base particles.

The aqueous medium usable is water or a solvent mixture of a water-miscible organic solvent and water.

Examples of the water-miscible organic solvent include alcohols such as methanol, isopropanol and ethylene glycol; cellosolves such as dimethylformamide, tetrahydrofuran and methyl cellosolve; and lower ketone such as acetone and methyl ethyl ketone. These may be used alone or in combination.

The aqueous medium preferably contains a surfactant.

The surfactant is not particularly limited, and examples thereof include anionic surfactants such as sulfuric acid esters, sulfonic acid salts, phosphoric acid esters and soap; cationic surfactants such as amine salts and quaternary ammonium salts; and nonionic surfactants such as polyethylene glycols, alkylphenolethyleneoxide adducts and polyhydric alcohols. These may be used alone or in combination. Of these, anionic surfactants or cationic surfactants are preferred. Also, nonionic surfactants are preferably used in combination with anionic surfactants or cationic surfactants. Furthermore, preferably, an anionic surfactant(s) is used when preparing the first liquid, second liquid and third liquid, and a cationic surfactant(s) is used when preparing the fourth liquid.

The anionic surfactant is not particularly limited, and examples thereof include fatty acid soaps such as potassium laurate, sodium oleate and caster oil sodium salt; sulfuric acid esters such as octyl sulfate, lauryl sulfate, lauryl ether sulfate and nonylphenyl ether sulfate; sulfonic acid salts such as lauryl sulfonate, dodecylbenzene sulfonate, alkylnaphthalene sulfonate (e.g., triisopropylnaphthalene sulfonate and dibutylnaphthalene sulfonate), naphthalene sulfonate-formalin condensate, monooctylsulfosuccinate, dioctylsulfosuccinate, lauric acid amide sulfonate and oleic acid amide sulfonate; phosphoric acid esters such as lauryl phosphate, isopropyl phosphate and nonylphenyl ether phosphate; and sulfosuccinic acid salts such as dialkylsulfosuccinic acid salts (e.g., sodium dioctylsulfosuccinate) and 2-sodium lauryl sulfossucinate.

The cationic surfactant is not particularly limited, and examples thereof include amine salts such as lauryl amine hydrochloride, stearyl amine hydrochloride, oleyl amine acetate, stearyl amine acetate and stearylaminopropyl amine acetate; and quaternary ammonium salts such as lauryl trimethyl ammonium chloride, dilauryl dimethyl ammonium chloride, distearyl ammonium chloride, distearyl dimethyl ammonium chloride, lauryl dihydroxyethylmethyl ammonium chloride, oleyl bis(polyoxyethylene) methyl ammonium chloride, lauroyl aminopropyl dimethyl ethyl ammonium ethosulfate, lauroyl aminopropyl dimethyl hydroxyethyl ammonium perchlorate, alkylbenzene dimethyl ammonium chloride and alkyltrimethyl ammonium chloride.

The nonionic surfactant is not particularly limited, and examples thereof include: alkyl ethers such as polyoxyethylene octyl ether, polyoxyethylene lauryl ether, polyoxyethylene stearyl ether and polyoxyethylene oleyl ether; alkylphenyl ethers such as polyoxyethylene octylphenyl ether and polyoxyethylene nonylphenyl ether; alkyl esters such as polyoxyethylene laurate, polyoxyethylene stearate and polyoxyethylene oleate; alkyl amines such as polyoxyethylene laurylamino ether, polyoxyethylene stearylamino ether, polyoxyethylene oleylamino ether, polyoxyethylene soyamino ether and polyoxyethylene beef tallow-amino ether; alkyl amides such as polyoxyethylene lauric acid amide, polyoxyethylene stearic acid amide and polyoxyethylene oleic acid amide; vegetable oil ethers such as polyoxyethylene caster oil ether and polyoxyethylene rapeseed oil ether; alkanol amides such as lauric diethanolamide, stearic diethanolamide and oleic diethanolamide; and sorbitan ester ethers such as polyoxyethylene sorbitan monolaurate, polyoxyethylene sorbitan monopalmitate, polyoxyethylene sorbitan monostearate and polyoxyethylene sorbitan monooleate.

The amount of the surfactant contained in the first liquid is generally 0.01% by mass to 1% by mass, preferably 0.02% by mass to 0.5% by mass, more preferably 0.1% by mass to 0.2% by mass. When the amount of the surfactant contained in the first liquid is less than 0.01% by mass, the crystalline polyester may aggregate. Whereas when the amount thereof is more than 1% by mass, the surfactant remains in the formed toner, resulting in that the toner may be degraded in chargeability under high-temperature, high-humidity conditions.

The amount of the surfactant contained in the second liquid is generally 0.01% by mass to 1% by mass, preferably 0.02% by mass to 0.5% by mass, more preferably 0.1% by mass to 0.2% by mass. When the amount of the surfactant contained in the second liquid is less than 0.01% by mass, the non-crystalline polyester may aggregate. Whereas when the amount thereof is more than 1% by mass, the surfactant remains in the formed toner, resulting in that the toner may be degraded in chargeability under high-temperature, high-humidity conditions.

The amount of the surfactant contained in the third liquid is generally 0.01% by mass to 10% by mass, preferably 0.1% by mass to 5% by mass, more preferably 0.5% by mass to 0.2% by mass. When the amount of the surfactant contained in the third liquid is less than 0.01% by mass, the colorant may be released when aggregating particles. Whereas when the amount thereof is higher than 10% by mass, the particle size distribution of the colorant may become difficult to control.

The amount of the surfactant contained in the fourth liquid is generally 0.01% by mass to 10% by mass, preferably 0.1% by mass to 5% by mass, more preferably 0.5% by mass to 0.2% by mass. When the amount of the surfactant contained in the fourth liquid is less than 0.01% by mass, the releasing agent may be released when aggregating particles. Whereas when the amount thereof is higher than 10% by mass, the particle size distribution of the releasing agent may become difficult to control.

Notably, the toner-forming materials other than the resin may be added after the base particles have been formed. For example, the base particles containing no colorant may be formed and then dyed.

In order to stabilize aggregated particles and control the particle size distribution thereof, an aggregating agent may be used when mixing together the first liquid, second liquid, third liquid and fourth liquid to aggregate particles.

The aggregating agent is not particularly limited so long as it is a compound having one or more charges. Examples thereof include ionic surfactants; acids such as hydrochloric acid, sulfuric acid, nitric acid, acetic acid and oxalic acid; metal salts of inorganic acids such as magnesium chloride, sodium chloride, aluminum sulfate, calcium sulfate, ammonium sulfate, ammonium nitrate, silver nitrate, copper nitrate and sodium carbonate; metal salts of aliphatic or aromatic acids such as sodium acetate, potassium formate, sodium oxalate, sodium phthalate and potassium salicylate; metal salts of phenols such as sodium phenolate; metal salts of amino acids; and inorganic acid salts of aliphatic or aromatic amines such as triethanolamine hydrochloride and aniline hydrochloride. Of these, metal salts of inorganic acids are preferred considering stability of the aggregated particles, stability over time of the aggregating agent to heat, and easiness of removal by washing.

The amount of the aggregating agent having one charge is generally 3% by mass or less. The amount of the aggregating agent having two charges is generally 1% by mass or less. The amount of the aggregating agent having three charges is generally 0.5% by mass or less.

Prior to fusing the aggregated particles, a liquid containing other materials emulsified or dispersed in an aqueous medium may be added so that the other materials are attached onto the surfaces of the aggregated particles.

In the present embodiment, the temperature at which the liquid containing the aggregated particles is heated is equal to or higher than a melting point of the crystalline polyester, where the melting point is determined from a DSC curve of the crystalline polyester obtained in the first elevation of temperature thereof, and is equal to or higher than a glass transition temperature of the non-crystalline polyester, where the glass transition temperature is determined from a DSC curve of the non-crystalline polyester obtained in the first elevation of temperature thereof. Thus, the aggregated particles are fused together.

The fused particles are washed, if necessary. Specifically, first, an acidic or basic water is added to the fused particles in an amount by mass several times that of the fused particles, followed by stirring and then filtrating. Next, pure water is added to the fused particles in an amount by mass several times that of the fused particles, followed by stirring and then filtrating. This treatment is repeated until the pH of the filtrate becomes about 7.

The washed particles are dried at a temperature that is lower than the above-determined melting point of the crystalline polyester and is lower than the above-determined glass transition temperature of the non-crystalline polyester. For drying the washed particles, if necessary, the washed particles may be treated with circulated dry air or heated in vacuum.

The fused particles each contain the crystalline polyester and the non-crystalline polyester which have been compatible together. However, in the present embodiment, the liquid containing the aggregated particles is annealed for 48 hours or longer at a temperature falling within a range of an onset temperature X (see FIG. 2) ±5° C. where the onset temperature X is determined from a DSC curve of the crystalline polyester in the first elevation of temperature. As a result, the crystalline polyester and the non-crystalline polyester are phase-separated from each other. Here, the time for which the annealing is performed is preferably 200 hours or shorter.

When the temperature at which the annealing is performed is lower than (the onset temperature X−5° C.) or higher than (the onset temperature X+5° C.) or the time for which the annealing is performed is shorter than 48 hours, the crystalline polyester and the non-crystalline polyester are not phase-separated from each other. The formed toner has a temperature width W (see FIG. 1) exceeding 8° C. where the temperature width W is a temperature width at ⅓ the height of an endothermic peak in a DSC curve of the toner obtained in the first elevation of temperature thereof. As a result, the toner is degraded in heat resistant storage stability.

Notably, the annealing of the fused particles may be performed before washing of the fused particles, or before or after drying of the washed particles.

The base particles may be mixed with a charge controlling agent, a flowability improving agent, a cleanability improving agent, etc.

The method for mixing the base particles with the charge controlling agent, flowability improving agent, cleanability improving agent, etc. is not particularly limited, and examples thereof include a method in which an impact is applied to the particles with a blade rotated at a high speed and a method in which the particles are caused to pass through a high-speed airflow for acceleration and aggregated particles or complex particles are crushed against an appropriate collision plate.

The apparatus with which the base particles are mixed with the charge controlling agent, flowability improving agent, cleanability improving agent, etc. is not particularly limited, and examples thereof include ONGMILL (product of Hosokawa Micron Corp.), an apparatus produced by modifying an I-TYPE MILL (product of Nippon Neumatic Co., Ltd.) so that the pulverizing air pressure thereof is decreased, HYBRIDIZATION SYSTEM (product of Nara Machinery Co., Ltd.), CRYPTRON SYSTEM (production of Kawasaki Heavy Industries, Ltd.) and an automatic mortar.

(Developer)

A developer of the present invention contains the toner of the present invention. The developer may be a magnetic or non-magnetic one-component developer formed of the toner or a two-component developer formed of the toner and a carrier.

The amount of the carrier contained in the two-component developer is generally 90% by mass to 98% by mass, preferably 93% by mass to 97% by mass.

The carrier preferably contains a core and a resin layer covering the core.

The material of the core is not particularly limited, and examples thereof include manganese-magnesium-based materials and manganese-strontium-based materials of 50 emu/g to 90 emu/g. These may be used alone or in combination. From the viewpoint of ensuring desired image density, strongly magnetized materials such as iron of 100 emu/g or higher and magnetite of 75 emu/g to 120 emu/g are preferably used. Meanwhile, from the viewpoint of advantageously attaining high image quality and weakening impact on a photoconductor on which toner particles are retained in the chain-like form, weakly magnetized materials such as copper-zinc-based materials of 30 emu/g to 80 emu/g are preferably used.

The core generally has a volume average particle diameter of 10 μm to 150 μm, more preferably 20 μM to 80 μm. When the volume average particle diameter is smaller than 10 μm, the magnetization per particle becomes small to potentially make it easier for the formed carriers to be scattered. Whereas when the volume average particle diameter is greater than 150 μm, the specific surface area of the carrier decreases, potentially causing toner scattering.

The material of the resin layer is not particularly limited, and examples thereof include amino resins such as urea-formaldehyde resins, melamine resins, benzoguanamine resins, urea resins, polyamide resins and epoxy resins; polyvinyl resins such as acrylic resins, polymethyl mathacrylates, polyacrylonitriles, polyvinyl acetates, polyvinyl alcohols and polyvinyl butyrals; polystyrene resins such as polystyrenes and styrene-acrylic copolymers; polyhalogenated olefins, polyesters, polyvinyl chlorides, polycarbonates, polyester resins such as polyethylene terephthalates and polybutylene terephthalates; polyethylenes, polyvinyl fluorides, polyvinylidene fluorides, polytrifluoroethylenes, polyhexafluoropropylenes, vinylidene fluoride-acryl copolymers, vinylidene fluoride-vinyl fluoride copolymers, fluorine-containing resins such as copolymers of tetrafluoroethylene, vinylidene fluoride and a monomer containing no fluoro group; and silicone resins. These may be used alone or in combination.

The resin layer may contain conductive powder.

The material of the conductive powder is not particularly limited, and examples thereof include metals, carbon black, titanium oxide, tin oxide and zinc oxide.

The average particle diameter of the conductive powder is generally 1 μm or smaller. When the average particle diameter of the conductive powder is greater than 1 μm, the electrical resistance of the formed resin layer may be difficult to control.

The resin layer can be formed, for example, as follows. Specifically, a resin is dissolved in a solvent to prepare a coating liquid, and then the thus-prepared coating liquid is applied onto the core surface, followed by drying and baking.

The solvent is not particularly limited, and examples thereof include toluene, xylene, methyl ethyl ketone, methyl isobutyl ketone, butyl acetate and cellosolve.

The method for applying the coating liquid is not particularly limited, and examples thereof include immersion methods, spray methods and brush coating methods.

The baking method is not particularly limited, and examples thereof include an external heating method employing a fixed-type electric furnace, a fluid-type electric furnace, a rotary electric furnace or a burner furnace; and an internal heating method employing microwave radiation.

The amount of the resin layer contained in the carrier is generally 0.01% by mass to 5.0% by mass. When the amount thereof is less than 0.01% by mass, a uniform resin layer may be difficult to form on the core surface. Whereas when the amount thereof is more than 5.0% by mass, the formed carrier particles may aggregate with each other.

(Image Forming Apparatus)

An image forming apparatus of the present invention includes: a photoconductor; a charging unit configured to charge the photoconductor; an exposing unit configured to expose the charged photoconductor to light to form a latent electrostatic image; a developing unit configured to develop the latent electrostatic image formed on the photoconductor with the developer of the present invention to form a toner image; a transfer unit configured to transfer the toner image formed on the photoconductor onto a recording medium; and a fixing unit configured to fix the transferred toner image on the recording medium. Here, the image forming apparatus of the present invention preferably further includes a cleaning unit configured to clean the photoconductor from which the toner image has been transferred. Also, the image forming apparatus of the present invention may optionally include a charge-eliminating unit configured to charge-eliminate the cleaned photoconductor and a recycling unit configured to recycle the toner removed through the cleaning of the photoconductor.

<Photoconductor>

The shape of the photoconductor is not particularly limited but preferably has a drum shape.

The material of the photoconductor is not particularly limited, and examples thereof include inorganic compounds such as amorphous silicon and serene; and organic compounds such as polysilane and phthalopolymethine. Among them, amorphous silicon is preferred in terms of exhibiting a long service life.

<Charging Unit>

The charging unit is not particularly limited, and examples thereof include contact charging devices having a conductive or semi-conductive roller, brush, film, or rubber blade; and non-contact charging devices employing corona discharge such as a corotron and a scorotron.

Examples of the method for charging the photoconductor include a method in which a voltage is applied to the surface of the photoconductor with the charging unit.

<Exposing Unit>

The exposing unit is not particularly limited, and examples thereof include various exposing devices such as copy optical systems, rod lens array systems, laser optical systems and liquid crystal shutter optical systems.

Examples of the method for exposing the charged photoconductor to light include a method in which the surface of the photoconductor is exposed to light with the exposing unit. Also, a method in which the photoconductor is exposed from the backside thereof may be employed.

<Developing Unit>

The developing unit is not particularly limited so long as it can apply the toner of the present invention to the latent electrostatic image formed on the photoconductor in a contact or non-contact manner. Examples of the developing device include a developing device containing a rotatable magnet roller and a stirring device configured to stir and charge a two-component developer; i.e., the developer of the present invention. In the stirring device, the toner of the present invention and carrier are stirred so that the developer of the present invention is charged by friction generated through stirring. The charged developer is retained in the chain-like form on the surface of the rotating magnetic roller to form a magnetic brush. The magnetic roller is disposed in the vicinity of the photoconductor and thus, some of the toner forming the magnetic brush are applied on the latent electrostatic image formed on the surface of the photoconductor due to electrostatic attractive force. As a result, the latent electrostatic image formed on the photoconductor surface is developed with the developer of the present invention to form a toner image.

Examples of the method for developing the latent electrostatic image formed on the photoconductor with the developer of the present invention include a method in which the toner of the present invention is applied with the developing unit onto the latent electrostatic image formed on the surface of the photoconductor.

Notably, the developer of the present invention contained in the developing unit may be a one-component developer or a two-component developer.

<Transfer Unit>

The transfer unit is not particularly limited, and examples thereof include a corona transfer device employing corona discharge, a transfer belt, a transfer roller, a press transfer roller and an adhesion transfer device.

Examples of the method for transferring the toner image formed on the photoconductor onto the recording medium include a method in which the toner image formed on the surface of the photoconductor is transferred with a transfer device onto a surface of the recording medium. Preferably, the toner image formed on the photoconductor surface is first transferred onto a surface of an intermediate transfer member, and then the toner image transferred onto the surface of the intermediate transfer member is transferred onto a surface of the recording medium. In another employable manner, toner images of respective colors formed on the surface of the photoconductor are first transferred onto a surface of the intermediate transfer member to form a composite toner image, and then the composite toner image formed on the surface of the intermediate transfer member is transferred onto a surface of the recording medium.

The intermediate transfer member is not particularly limited, and examples thereof include an endless transfer belt.

The recording medium is not particularly limited, and examples thereof include known recording paper.

<Fixing Unit>

The fixing unit is not particularly limited, and examples thereof include a combination of a heating roller and a pressing roller; and a combination of a heating roller, a pressing roller and an endless belt. The temperature of the heating roller is generally 80° C. to 200° C. If necessary, a known photo-fixing device may be used together with or instead of the fixing unit.

Examples of the method for fixing the toner image transferred onto the recording medium include a method in which the toner image transferred onto the surface of the recording medium is fixed with a fixing device. When forming a full-color image, fixing may be performed every after an image formed by each color toner has been transferred onto the recording medium; or fixing may be performed at one time after images formed by all color toners have been transferred on the recording medium.

<Cleaning Unit>

The cleaning unit is not particularly limited so long as it can remove the toner remaining on the photoconductor. Examples thereof include a magnetic blush cleaner, an electrostatic brush cleaner, a magnetic roller cleaner, a blade cleaner, a brush cleaner or a web cleaner.

Examples of the method for cleaning the photoconductor include a method in which the toner remaining on the surface of the photoconductor is removed with a cleaning device.

<Charge-Eliminating Unit>

The charge-eliminating unit is not particularly limited so long as it can apply a charge-eliminating bias to the photoconductor surface. Examples thereof include a charge-eliminating lamp.

Examples of the method for charge-eliminating the photoconductor include a method in which a charge-eliminating bias is applied to the photoconductor surface with the charge-eliminating unit.

<Recycling Unit>

The recycling unit is not particularly limited, and examples thereof include known conveyance units.

Examples of the method for recycling the removed toner include a method in which the removed toner is conveyed with the recycling unit to the developing unit.

<Controlling Unit>

The controlling unit is not particularly limited so long as it can control the operation of each device. Examples thereof include a sequencer or a computer.

Notably, each of the devices can be controlled with a controlling unit.

EXAMPLES

The present invention will next be described in detail by way of Examples, which should not be construed as limiting the present invention thereto. Note that the unit "part(s)" means "part(s) by mass."

[Synthesis of Crystalline Polyester 1]

A reaction container to which a condenser, a stirrer and a nitrogen-introducing tube had been set was charged with 1,10-decanediol (2,500 parts), 1,8-octanedioic acid (2,330 parts) and hydroquinone (2.9 parts). The resultant mixture was allowed to react at 180° C. for 30 hours. Then, the reaction mixture was heated to 200° C. and allowed to react for 10 hours. Furthermore, the reaction mixture was allowed to react at 8.3 kPa for 15 hours, to thereby produce crystalline polyester 1. The crystalline polyester 1 was found to have an onset temperature of 55° C., a melting point of 72° C., a weight average molecular weight of $1.95\times10^4$, an acid value of 22 mgKOH/g and a hydroxyl value of 2 mgKOH/g.

[Onset Temperature and Melting Point]

The onset temperature and melting point of the crystalline polyester were measured with a differential scanning calorimeter DSC-60 (product of Shimadzu Corporation). Specifically, first, a sample (about 5.0 mg) was placed in an aluminum sample container, which was placed on a holder unit. The holder unit was then set in an electric oven. In a nitrogen atmosphere, the sample was heated from 0° C. to 150° C. at a temperature increasing rate of 10° C./min, cooled from 150° C. to 0° C. for at a temperature decreasing rate of 10° C./min, and heated to 150° C. at a temperature increasing rate of 10° C./min. Using the obtained DSC curve and the analysis program of DSC-60 system, the DSC curve of the first temperature elevation was selected to determine an onset temperature and melting point according to the method described above in detail.

[Weight Average Molecular Weight and Number Average Molecular Weight]

The weight average molecular weight and number average molecular weight of the crystalline polyester were measured through GPC using o-dichlorobenzene as a solvent in the following manner.

Specifically, a column was conditioned in a heat chamber at 145° C. Then, o-dichlorobenzene containing BHT in an amount of 0.3% by mass, serving as an eluent, was caused to pass through the column at a flow rate of 1 mL/min with the temperature being maintained. Subsequently, a separately prepared o-dichlorobenzene solution (140° C.) of resin (concentration: 0.3% by mass) was applied to the column in an amount of 50 μL to 200 μL. The measurement apparatus used was model 150CV (product of Waters) and the column used was Shodex AT-G+AT-806MS (2 columns) (product of SHOWA DENKO K.K.). In the measurement of the molecular weight of the sample (toner), the molecular weight distribution of the sample was determined based on the relationship between the logarithmic value and the count number of a calibration curve given by using several monodisperse polystyrene-standard samples. The slice width was 0.05 sec.

The standard polystyrene samples for preparing the calibration curve were TSK-GEL standard substance "PS-Polymer Kit" (product of TOSOH CORPORATION). Also, the detector used was a refractive index (RI) detector.

[Acid Value]

The acid value of the crystalline polyester was measured according to the method described in JIS K0070, provided that only the measurement solvent was changed from the ethanol-ether solvent mixture defined in JIS K0070 to an acetone-toluene solvent mixture (acetone toluene=1:1 (by volume)).

[Hydroxyl Value]

The hydroxyl value of the crystalline polyester was measured according to the method described in JIS K0070, provided that only the measurement solvent was changed from the ethanol-ether solvent mixture defined in JIS K0070 to an acetone-toluene solvent mixture (acetone toluene=1:1 (by volume)).

[Synthesis of Non-Crystalline Polyester 1]

A reaction container to which a condenser, a stirrer and a nitrogen-introducing tube had been set was charged with 229 parts of bisphenol A ethylene oxide 2 mol adduct, 529 parts of bisphenol A propion oxide 3 mol adduct, 100 parts of isophthalic acid, 108 parts of terephthalic acid, 46 parts of adipic acid and 2 parts of dibutyltinoxide. The resultant mixture was allowed to react at 230° C. for 10 hours and then at 10 mmHg to 15 mmHg for 5 hours. Thereafter, 30 parts of trimellitic anhydride was added to the reaction container, followed by reaction at 180° C. for 3 hours, to thereby produce non-crystalline polyester 1. The non-crystalline polyester 1 was found to have a number average molecular weight of $1.8\times10^3$, a weight average molecular weight of $5.5\times10^3$, a glass transition temperature of 50° C. and an acid value of 20 mgKOH/g.

[Synthesis of Non-Crystalline Polyester 2]

A reaction container to which a condenser, a stirrer and a nitrogen-introducing tube had been set was charged with 229 parts of bisphenol A ethylene oxide 2 mol adduct, 529 parts of bisphenol A propion oxide 3 mol adduct, 84 parts of isophthalic acid, 91 parts of terephthalic acid, 76 parts of adipic acid and 2 parts of dibutyltinoxide. The resultant mixture was allowed to react at 230° C. for 10 hours and then at 10 mmHg to 15 mmHg for 5 hours. Thereafter, 30 parts of trimellitic anhydride was added to the reaction container, followed by reaction at 180° C. for 3 hours, to thereby produce non-crystalline polyester 2. The non-crystalline polyester 2 was found to have a number average molecular weight of $1.9\times10^3$, a weight average molecular weight of $5.7\times10^3$, a glass transition temperature of 43° C. and an acid value of 22 mgKOH/g.

[Weight Average Molecular Weight and Number Average Molecular Weight]

The weight average molecular weight and the number average molecular weight of the non-crystalline polyester resin were measured with the same method as in the case of the crystalline polyester resin.

[Glass Transition Temperature]

The glass transition temperature of the non-crystalline polyester resin was measured with a differential scanning calorimeter DSC-60 (product of Shimadzu Corporation). Specifically, first, about 5.0 mg of a sample was placed in a sample container made of aluminum; the sample container was placed on a holder unit; and the holder unit was set in an electric furnace. Next, a DSC curve of the sample was obtained by increasing or decreasing its temperature in a nitrogen atmosphere as follows. Specifically, it was heated from 0° C. to 150° C. at a temperature increasing rate of 10° C./rain; it was cooled from 150° C. to 0° C. at a temperature decreasing rate of 10° C./min; and it was heated again to 150° C. at a temperature increasing rate of 10° C./rain. Using the thus-obtained DSC curve and an analysis program of the DSC-60 system, the DSC curve in the first elevation of temperature was selected to determine the glass transition temperature of the sample.

[Acid Value]

The acid value of the non-crystalline polyester resin was measured according to the method described in JIS K0070-1992. Specifically, 0.5 g of the non-crystalline polyester resin was added to 120 mL of toluene, and the resultant mixture was stirred for about 10 hours at room temperature (23° C.) for dissolution. In addition, 30 mL of ethanol was added to the resultant solution to prepare a sample solution.

The sample solution was titrated with a pre-standardized N/10 potassium hydroxide/alcohol solution and then the acid value thereof was calculated from the amount of the pre-standardized N/10 potassium hydroxide/alcohol solution consumed using the equation:

$$\text{Acid value}=\text{KOH (mL)}\times N\times 56.1/\text{mass of sample},$$

where N is a factor of N/10 KOH.

[Hydroxyl Value]

The hydroxyl value of the non-crystalline polyester resin was measured according to the method described in JIS K0070-1966. Specifically, 0.5 g of the non-crystalline polyester resin was accurately weighed in a 100 mL measuring flask, and then 5 mL of an acetylation reagent was accurately added thereto. Next, the measuring flask was heated in a bath set to 100° C.±5° C. One hour to two hours after, the measuring flask was taken out from the bath and left to cool. In addition, water was added to the measuring flask, which was then shaken to decompose acetic anhydride. Next, for completely decomposing acetic anhydride, the flask was heated again in the bath for 10 min or longer and then left to cool. Thereafter, the wall of the flask was thoroughly washed with an organic solvent. Using electrodes, the OH value of the thus-prepared liquid was measured through potentiometric titration with N/2 ethanol solution of potassium hydroxide.

[Preparation of Crystalline Polyester Dispersion Liquid 1]

First, 1,600 parts of the crystalline polyester 1 and 11,200 parts of ethyl acetate were added to a container, where the crystalline polyester 1 was dissolved in the ethyl acetate at 75° C. The resultant solution was quenched at a temperature decreasing rate of 27° C./min in an ice-water bath. Next, 3,200 parts of the non-crystalline polyester 1 was added thereto, followed by stirring for 5 hours, to thereby dissolve the non-crystalline polyester 1 in the ethyl acetate. Furthermore, the resultant solution was treated with a beads mill LMZ2 (product of Ashizawa Finetech Ltd.) under the following conditions: the amount of zirconia beads having a particle diameter of 0.3 mm packed: 85% by volume; liquid temperature: 26° C.; pass time: 20, to thereby prepare a crystalline polyester dispersion liquid 1.

[Preparation of Crystalline Polyester Dispersion Liquid 2]

A crystalline polyester dispersion liquid 2 was prepared in the same manner as in the crystalline polyester dispersion liquid 1, except that the liquid temperature in the beads mill was changed to 30° C.

[Preparation of Crystalline Polyester Dispersion Liquid 3]

A crystalline polyester dispersion liquid 3 was prepared in the same manner as in the crystalline polyester dispersion liquid 1, except that the liquid temperature in the beads mill was changed to 34° C.

[Synthesis of Polyester Prepolymer 1]

A reaction container to which a condenser, a stirrer and a nitrogen-introducing tube had been set was charged with 682 parts of bisphenol A ethylene oxide 2 mol adduct, 81 parts of bisphenol A propylene oxide 2 mol adduct, 283 parts of terephthalic acid, 22 parts of trimellitic anhydride and 2 parts of dibutyltinoxide. The resultant mixture was allowed to react at 230° C. for 8 hours and then at 10 mmHg to 15 mmHg for 5 hours, to thereby obtain a hydroxyl group-containing polyester. The hydroxyl group-containing polyester was found to have a number average molecular weight of $2.1\times10^3$, a weight average molecular weight of $9.5\times10^3$, a glass transition temperature of 55° C., an acid value of 0.5 mgKOH/g and a hydroxyl value of 51 mgKOH/g.

Next, a reaction container equipped with a condenser, a stirrer and a nitrogen-introducing tube was charged with 410 parts of the hydroxyl group-containing polyester, 89 parts of isophoron diisocyanate and 500 parts of ethyl acetate. The resultant mixture was allowed to react at 100° C. for 5 hours to obtain polyester prepolymer 1. The amount of the free isocyanate group contained in the polyester prepolymer 1 was found to be 1.53% by mass.

[Amount of Free Isocyanate Group]

The amount of the free isocyanate group was measured as follows. Specifically, about 2 g of the polyester prepolymer 1 (sample) was accurately weighed, and 5 mL of dry toluene was immediately mixed therewith to completely dissolve the sample. Subsequently, 5 mL of 0.1 M n-dibutylamine/toluene solution was added to the resultant solution with a pipette, followed by gently stirring for 15 min. In addition, 5 mL of isopropanol was added thereto, followed by stirring. The resultant mixture was subjected to potentiometric titration using 0.1M ethanol standard liquid of hydrochloric acid. The obtained titration value was used to calculate the amount of dibutylamine consumed, which was then used to calculate the amount of the free isocyanate group.

[Synthesis of Ketimine 1]

A reaction container to which a stirring rod and a thermometer had been set was charged with 170 parts of isophorondiamine and 75 parts of methyl ethyl ketone, followed by reaction at 50° C. for 5 hours, to thereby obtain ketimine 1. The ketimine 1 was found to have an amine value of 418 mgKOH/g.

[Amine Value]

Sample Preparation: 1.0 g of the ketimine 1 was added to 50 mL of dimethylformamide, followed by stirring at room temperature (23° C.) for about 10 hours, to thereby prepare a sample solution.

The sample solution was titrated with a pre-standardized 1/100N hydrochloric acid/alcohol solution and then the amine value thereof was calculated from the amount of the pre-standardized 1/100N hydrochloric acid/alcohol solution consumed using the equation:

$$\text{Amine value}=0.561\times(\text{amount of the pre-standardized solution (mL)})\times N(\text{factor of the pre-standardized solution})/\text{mass of sample (g)}.$$

[Preparation of Masterbatch 1]

Water (1,200 parts), 540 parts of carbon black (Printex35, product of Deggusa Co.) (DBP oil-absorption amount=42 mL/100 g, pH=9.5) and 1,200 parts of the non-crystalline polyester 1 were mixed together using HENSCHEL MIXER (product of Mitsui Mining Co.). Using a two-roll mill, the resultant mixture was kneaded at 150° C. for 30 min, followed by calendering, cooling and pulverizing with a pulverizer (product of HOSOKAWA MICRON CORPORATION), to thereby obtain masterbatch 1.

[Preparation of Aqueous Medium 1]

A reaction container to which a stirring rod and a thermometer had been set was charged with 683 parts of water, 11 parts of a sodium salt of sulfate of an ethylene oxide adduct of methacrylic acid (Eleminol RS-30, product of Sanyo Chemical Industries, Ltd.), 138 parts of styrene, 138 parts of methacrylic acid and 1 part of ammonium persulfate. The resultant mixture was stirred at 400 rpm for 15 min and then heated to 75° C., followed by reaction for 5 hours. Next, 30 parts of a 1% by mass aqueous ammonium persulfate solution was added to the reaction mixture, and the resultant mixture was aged at 75° C. for 5 hours, to thereby obtain a dispersion liquid containing resin particles dispersed therein (resin particle dispersion liquid). Through measurement with a laser diffraction/scattering particle size distribution analyzer LA-920 (product of HORIBA Co.), the resin particles contained in the dispersion liquid was found to have a volume average particle diameter of 0.14 μm.

Water (990 parts), 83 parts of the resin particle dispersion liquid, 37 parts of a 48.5% by mass aqueous solution of sodium dodecyldiphenyletherdisulfonate (Eleminol MON-7, product of Sanyo Chemical Industries, Ltd.) and 90 parts of ethyl acetate were mixed together to prepare an aqueous medium 1.

Example 1-1

A container to which a stirring rod and a thermometer had been set was charged with 378 parts of the non-crystalline polyester 1, 110 parts of a microcrystalline wax HIMIC-1090 (product of NIPPON SEIRO CO., LTD.), 22 parts of a salicylic acid metal complex BONTRON E-84 (product of Orient Chemical Industries, Ltd.) and 947 parts of ethyl acetate. Then, the resultant mixture was increased in temperature to 80° C. under stirring, maintained at the same temperature for 5 hours, and cooled to 30° C. for 1 hour. Next, 500 parts of the masterbatch 1 and 500 parts of ethyl acetate were added to the container, followed by mixing for 1 hour, to thereby obtain a mixture.

Next, 1,324 parts of the obtained mixture was placed in another container, and was treated with a beads mill ULTRA VISCO MILL (product of Aymex Co.) under the following conditions: the amount of zirconia beads having a particle diameter of 0.5 mm packed: 80% by volume; liquid-feeding rate: 1 kg/h; disc circumferential speed: 6 m/sec; pass time: 3, to thereby prepare a dispersion liquid.

Next, 1,042.3 parts of 65% by mass ethyl acetate solution of the non-crystalline polyester 1 was added to the obtained dispersion liquid and passed with the beads mill once under the same conditions as employed above, to thereby obtain a dispersion liquid. The concentration of the solid content of the obtained dispersion liquid was found to be 50% by mass as measured under heating at 130° C. for 30 min.

Next, a container was charged with 664 parts of the obtained dispersion liquid, 109.4 parts of the polyester prepolymer 1, 73.9 parts of the crystalline polyester dispersion liquid 1 and 4.6 parts of the ketimine 1. The resultant mixture was mixed with TK homomixer (product of PRIMIX Corporation) at 5,000 rpm for 1 min. The aqueous medium 1 (1,200 parts) was added to the container, followed by mixing using the TK homomixer at 13,000 rpm for 20 min, to thereby obtain an emulsified slurry.

Next, the emulsified slurry was added to a container to which a stirrer and a thermometer had been set, followed by desolvating at 30° C. for 8 hours and aging at 45° C. for 4 hours, to thereby obtain a dispersion slurry.

The dispersion slurry (100 parts) was filtrated under reduced pressure. Then, 100 parts of ion-exchanged water was added to the filtration cake, followed by mixing with a TK homomixer (product of PRIMIX Corporation) at 12,000 rpm for 10 min and then filtration. Next, 100 parts of 10% by mass aqueous sodium hydroxide solution was added to the obtained filtration cake, followed by mixing with a TK homomixer (product of PRIMIX Corporation) at 12,000 rpm for 30 min and then filtration. Next, 100 parts of 10% by mass hydrochloric acid was added to the obtained filtration cake, followed by mixing with a TK homomixer (product of PRIMIX Corporation) at 12,000 rpm for 10 min and then filtration. Next, 300 parts of ion-exchanged water was added to the obtained filtration cake, followed by mixing with a TK homomixer (product of PRIMIX Corporation) at 12,000 rpm for 10 min and then filtration. A series of the above treatments were performed twice. The obtained filtration cake was dried with an air-circulating drier at 45° C. for 48 hours, and then was classified with a mesh having an aperture of 75 μm, to thereby prepare base particles.

Using HENSCHEL MIXER (product of Mitsui Mining Co.), 100 parts of the obtained base particles was mixed with 0.7 parts of hydrophobic silica HDK-2000 having an average primary particle diameter of 20 nm (product of WACKER ASAHIKASEI SILICONE CO., LTD.) and 0.3 parts of hydrophobic titanium oxide having an average primary particle diameter of 20 nm, to thereby obtain a toner. The obtained toner was found to have a glass transition temperature of 52° C. where the glass transition temperature was determined from a DSC curve obtained in the first elevation of temperature, have a temperature width W of 6.8° C. where the temperature width W was a temperature width at ⅓ the height of an endothermic peak in the DSC curve of the toner obtained in the first elevation of temperature thereof, and also have a ½ effluent temperature $T_{1/2}$ of 120° C.

Example 1-2

The procedure of Example 1-1 was repeated, except that the crystalline polyester dispersion liquid 1 was changed to the crystalline polyester dispersion liquid 2, to thereby obtain a toner. The obtained toner was found to have a glass transition temperature of 52° C. where the glass transition temperature was determined from a DSC curve obtained in the first elevation of temperature, have a temperature width W of 4.1° C. where the temperature width W was a temperature width at ⅓ the height of an endothermic peak in the DSC curve of the toner obtained in the first elevation of temperature thereof, and also have a ½ effluent temperature $T_{1/2}$ of 120° C.

Comparative Example 1-1

The procedure of Example 1-1 was repeated, except that the crystalline polyester dispersion liquid 1 was changed to the crystalline polyester dispersion liquid 3, to thereby obtain a toner. The obtained toner was found to have a glass transition temperature of 52° C. where the glass transition temperature was determined from a DSC curve obtained in the first elevation of temperature, have a temperature width W of 10.8° C. where the temperature width W was a temperature width at ⅓ the height of an endothermic peak in the DSC curve of the toner obtained in the first elevation of temperature thereof, and also have a ½ effluent temperature $T_{1/2}$ of 120° C.

Comparative Example 1-2

The procedure of Example 1-1 was repeated, except that the non-crystalline polyester 1 was changed to the non-crystalline polyester 2, to thereby produce a toner (notably, the description "the non-crystalline polyester 1 was changed to the non-crystalline polyester 2" means that the non-crystalline polyester 1 contained in the crystalline polyester dispersion liquid 1 used in Example 1-1 was also changed to the non-crystalline polyester 2). The obtained toner was found to have a glass transition temperature of 44° C. where the glass transition temperature was determined from a DSC curve obtained in the first elevation of temperature, have a temperature width W of 6.2° C. where the temperature width W was a temperature width at ⅓ the height of an endothermic peak in the DSC curve obtained in the first elevation of temperature, and also have a ½ effluent temperature $T_{1/2}$ of 120° C.

[Synthesis of Non-Crystalline Polyester 3]

A reaction container to which a condenser, a stirrer and a nitrogen-introducing tube had been set was charged with 229 parts of bisphenol A ethylene oxide 2 mol adduct, 529 parts of bisphenol A propion oxide 3 mol adduct, 208 parts of terephthalic acid, 46 parts of adipic acid and 2 parts of dibutyltinoxide. The resultant mixture was allowed to react at 230° C. for 8 hours and then at 10 mmHg to 15 mmHg for 5 hours. Thereafter, 44 parts of trimellitic anhydride was added to the reaction container, followed by reaction at 180° C. for 6 hours, to thereby produce non-crystalline polyester 3. The non-crystalline polyester 3 was found to have a number average molecular weight of $5.5\times10^3$, a weight average molecular weight of $3.62\times10^4$, a glass transition temperature of 57° C. and an acid value of 23 mgKOH/g.

[Preparation of Crystalline Polyester Dispersion Liquid 4]

A crystalline polyester dispersion liquid 4 was prepared in the same manner as in the crystalline polyester dispersion liquid 1, except that the non-crystalline polyester 3 was used instead of the non-crystalline polyester 1.

[Preparation of Masterbatch 2]

A masterbatch 2 was prepared in the same manner as in the masterbatch 1, except that the non-crystalline polyester 3 was used instead of the non-crystalline polyester 1.

Example 1-3

A container to which a stirring rod and a thermometer had been set was charged with 288 parts of the non-crystalline polyester 3, 147 parts of a microcrystalline wax HIMIC-1090 (product of NIPPON SEIRO CO., LTD.), 22 parts of a salicylic acid metal complex BONTRON E-84 (product of Orient Chemical Industries, Ltd.) and 947 parts of ethyl acetate. Then, the resultant mixture was increased in temperature to 80° C. under stirring, maintained at the same temperature for 5 hours, and cooled to 30° C. for 1 hour. Next, 500 parts of the masterbatch 2 and 500 parts of ethyl acetate were added to the container, followed by mixing for 1 hour, to thereby obtain a mixture.

Next, 1,324 parts of the obtained mixture was placed in another container, and was treated with a beads mill ULTRA VISCO MILL (product of Aymex Co.) under the following conditions: the amount of zirconia beads having a particle diameter of 0.5 mm packed: 80% by volume; liquid-feeding rate: 1 kg/h; disc circumferential speed: 6 m/sec; pass time: 3, to thereby prepare a dispersion liquid.

Next, 1,042.3 parts of 65% by mass ethyl acetate solution of the non-crystalline polyester 3 was added to the obtained dispersion liquid and passed with the beads mill once under the same conditions employed above, to thereby obtain a dispersion liquid. The concentration of the solid content of the obtained dispersion liquid was found to be 50% by mass as measured under heating at 130° C. for 30 min.

Next, a container was charged with 778 parts of the obtained dispersion liquid and 73.9 parts of the crystalline polyester dispersion liquid 4. The resultant mixture was mixed with TK homomixer (product of PRIMIX Corporation) at 5,000 rpm for 1 min. The aqueous medium 1 (1,200 parts) was added to the container, followed by mixing using the TK homomixer at 9,000 rpm for 2 min, to thereby obtain an emulsified slurry.

Next, the emulsified slurry was added to a container to which a stirrer and a thermometer had been set, followed by desolvating at 30° C. for 8 hours, to thereby obtain a dispersion slurry.

The dispersion slurry (100 parts) was filtrated under reduced pressure. Then, 100 parts of ion-exchanged water was added to the filtration cake, followed by mixing with a TK homomixer (product of PRIMIX Corporation) at 12,000 rpm for 10 min and then filtration. Next, 100 parts of 10% by mass aqueous sodium hydroxide solution was added to the obtained filtration cake, followed by mixing with a TK homomixer (product of PRIMIX Corporation) at 12,000 rpm for 30 min and then filtration. Next, 100 parts of 10% by mass hydrochloric acid was added to the obtained filtration cake, followed by mixing with a TK homomixer (product of PRIMIX Corporation) at 12,000 rpm for 10 min and then filtration. Next, 300 parts of ion-exchanged water was added to the obtained filtration cake, followed by mixing with a TK homomixer (product of PRIMIX Corporation) at 12,000 rpm for 10 min and then filtration. A series of the above treatments were performed twice. The obtained filtration cake was dried with an air-circulating drier at 45° C. for 48 hours, and then was classified with a mesh having an aperture of 75 to thereby prepare base particles.

Using HENSCHEL MIXER (product of Mitsui Mining Co.), 100 parts of the obtained base particles was mixed with 0.7 parts of hydrophobic silica HDK-2000 having an average primary particle diameter of 20 nm (product of WACKER ASAHIKASEI SILICONE CO., LTD.) and 0.3 parts of hydrophobic titanium oxide having an average primary particle diameter of 20 nm, to thereby obtain a toner. The obtained toner was found to have a glass transition temperature of 52° C. where the glass transition temperature was determined from a DSC curve obtained in the first elevation of temperature, have a temperature width W of 6.7° C. where the temperature width W was a temperature width at ⅓ the height of an endothermic peak in the DSC curve of the toner obtained in the first elevation of temperature thereof, and also have a ½ effluent temperature $T_{1/2}$ of 120° C.

[Synthesis of Non-Crystalline Polyester 4]

A reaction container to which a condenser, a stirrer and a nitrogen-introducing tube had been set was charged with 780 parts by mole of polyoxypropylene(2,2)-2,2-bis(4-hydroxyphenyl)propane, 18 parts by mole of polyoxyethylene(2,2)-2,2-bis(4-hydroxyphenyl)propane, 47 parts by mole of terephthalic acid, 24 parts by mole of fumaric acid, 24 mole of n-dodecenylsuccinic acid and 9 parts by mole of dibutyltinoxide. The resultant mixture was allowed to react at 230° C. for 12 hours. Thereafter, the reaction mixture was gradually reduced in pressure at 230° C. to thereby obtain non-crystalline polyester 4. The non-crystalline polyester 4 was found to have a number average molecular weight of $6.7\times10^3$, a weight average molecular weight of $1.74\times10^4$, a glass transition temperature of 61° C. and an acid value of 14 mgKOH/g.

Example 2-1

First, 8 parts of the crystalline polyester 1, 86 parts of the non-crystalline polyester 4, 7 parts of carbon clack C-44 having an average particle diameter of 24 nm and a BET specific surface area of 125 $m^2/g$ (product of Mitsubishi Chemical Corporation), 1 part of a salicylic acid metal complex BONTRON E-84 (product of Orient Chemical Industries, Ltd.) and 6 parts of a microcrystalline wax HIMIC-1090 (product of NIPPON SEIRO CO., LTD.) were mixed together with SUPER MIXER SMV-200 (product of KAWATA MFG CO., Ltd.). The obtained mixture was fed to a material-feeding hopper of BUSS CO-KNEADER TCS-100 (product of BUSS Company) and then kneaded at a feed amount of 120 kg/h and a kneading temperature of 95° C. The kneaded product was calendered and cooled with a double belt cooler. The thus-treated product was coarsely pulverized with a hammer mill and then finely pulverized with I-20 jet mill (jet airflow-type mill) (product of Nippon Pneumatic Co.). The obtained pulverized product was classified with a wind-driven classifier DS-20•DS-10 (product of Nippon Pneumatic Co.). The obtained classified product was annealed at 55° C. for 50 hours to obtain base particles.

Using HENSCHEL MIXER (product of Mitsui Mining Co.), 100 parts of the obtained base particles was mixed with 0.7 parts of hydrophobic silica HDK-2000 having an average primary particle diameter of 20 nm (product of WACKER ASAHIKASEI SILICONE CO., LTD.) and 0.3 parts of hydrophobic titanium oxide having an average primary particle diameter of 20 nm, to thereby obtain a toner. The obtained toner was found to have a glass transition temperature of 55° C. where the glass transition temperature was determined from a DSC curve obtained in the first elevation of temperature, have a temperature width W of 8.0° C. where the temperature width W was a temperature width at ⅓ the height of an endothermic peak in the DSC curve of the toner obtained in the first elevation of temperature thereof, and also have a ½ effluent temperature $T_{1/2}$ of 130° C.

Example 2-2

The procedure of Example 2-1 was repeated, except that the time for which the classified product was annealed was changed to 100 hours, to thereby obtain a toner. The obtained toner was found to have a glass transition temperature of 55° C. where the glass transition temperature was determined from a DSC curve obtained in the first elevation of temperature, have a temperature width W of 5.6° C. where the temperature width W was a temperature width at ⅓ the height of an endothermic peak in the DSC curve of the toner obtained in the first elevation of temperature thereof, and also have a ½ effluent temperature $T_{1/2}$ of 130° C.

Example 2-3

The procedure of Example 2-1 was repeated, except that the amount of the crystalline polyester 1 added was changed to 5 parts, to thereby obtain a toner. The obtained toner was found to have a glass transition temperature of 55° C. where the glass transition temperature was determined from a DSC curve obtained in the first elevation of temperature, have a temperature width W of 2.0° C. where the temperature width W was a temperature width at ⅓ the height of an endothermic peak in the DSC curve of the toner obtained in the first elevation of temperature thereof, and also have a ½ effluent temperature $T_{1/2}$ of 135° C.

Comparative Example 2-1

The procedure of Example 2-1 was repeated, except that the classified product was not annealed, to thereby obtain a toner. The obtained toner was found to have a glass transition temperature of 60° C. where the glass transition temperature was determined from a DSC curve obtained in the first elevation of temperature, have a temperature width W of 11.2° C. where the temperature width W was a temperature width at ⅓ the height of an endothermic peak in the DSC curve of the toner obtained in the first elevation of temperature thereof, and also have a ½ effluent temperature $T_{1/2}$ of 130° C.

Comparative Example 2-2

The procedure of Example 2-1 was repeated, except that the kneading temperature was changed to 120° C., to thereby obtain a toner. The obtained toner was found to have a glass transition temperature of 55° C. where the glass transition temperature was determined from a DSC curve of the toner obtained in the first elevation of temperature thereof, have a temperature width W of 9.5° C. where the temperature width W was a temperature width at ⅓ the height of an endothermic peak in the DSC curve of the toner obtained in the first elevation of temperature thereof, and also have a ½ effluent temperature $T_{1/2}$ of 135° C.

Comparative Example 2-3

The procedure of Example 2-1 was repeated, except that the annealing temperature of the classified product was changed to 62° C., to thereby obtain a toner. The obtained toner was found to have a glass transition temperature of 55° C. where the glass transition temperature was determined from a DSC curve obtained in the first elevation of temperature thereof, have a temperature width W of 10.3° C. where the temperature width W was a temperature width at ⅓ the height of an endothermic peak in the DSC curve of the toner obtained in the first elevation of temperature thereof, and also have a ½ effluent temperature $T_{1/2}$ of 130° C.

[Preparation of Crystalline Polyester Dispersion Liquid 5]

A stainless steel beaker was charged with 180 parts of the crystalline polyester 1 and 585 parts of ion-exchanged water, and the resultant mixture was heated to 95° C. in a hot-water bath. At the time when the crystalline polyester 1 was melted and the mixture became transparent, 1% by mass aqueous ammonia was added to the mixture so as to have a pH of 7.0 under stirring at 10,000 rpm using T.K. ROBOMIX (product of PRIMIX Corporation). Next, the resultant mixture was dispersed while 20 parts of an aqueous solution containing 0.8 parts of anionic surfactant NEOGEN R-K (product of DAI-ICHI KOGYO SEIYAKU CO., LTD.) and 0.2 parts of nonionic surfactant EMULGEN 950 (product of DAI-ICHI KOGYO SEIYAKU CO., LTD.) diluted in water was being added dropwise thereto, to thereby obtain crystalline polyester dispersion liquid 5 having a solid content concentration of 11.9% by mass. The crystalline polyester contained in the obtained dispersion liquid was found to have a volume average particle diameter of 0.22 μm.

[Preparation of Non-Crystalline Polyester Dispersion Liquid 1]

The procedure for preparing the crystalline polyester dispersion liquid 5 was repeated, except that the crystalline polyester 1 was changed to the non-crystalline polyester 1, to thereby obtain non-crystalline polyester dispersion liquid 1 having a solid content concentration of 12.3% by mass. Also, the non-crystalline polyester contained in the obtained dispersion liquid was found to have a volume average particle diameter of 0.21 μm.

[Preparation of Pigment Dispersion Liquid 1]

A container was charged with 20 parts of carbon black MA100S (product of Mitsubishi Chemical Corporation), 80 parts of ion-exchanged water and 4 parts of anionic surfactant NEOGEN R-K (product of DAI-ICHI KOGYO SEIYAKU CO., LTD.). The resultant mixture was treated with a beads mill ULTRA VISCO MILL (product of Aymex Co.) under the following conditions: the amount of zirconia beads having a particle diameter of 0.3 mm packed: 80% by volume; liquid-feeding rate: 1 kg/h; disc circumferential speed: 6 m/sec; pass time: 15, to thereby prepare a pigment dispersion liquid 1 having a solid content concentration of 19.8% by mass. Also, the pigment contained in the dispersion liquid was found to have a volume average particle diameter of 0.07 μm.

[Preparation of Wax Dispersion Liquid 1]

A microcrystalline wax HIMIC-1090 (product of NIPPON SEIRO CO., LTD.) (20 parts), 80 parts of ion-exchanged water and 4 parts of anionic surfactant NEOGEN R-K (product of DAI-ICHI KOGYO SEIYAKU CO., LTD.) were mixed together. While being stirred, the resultant mixture was increased in temperature to 95° C. and maintained for 1 hour, followed by cooling. Next, the obtained mixture was treated with a beads mill ULTRA VISCO MILL (product of Aymex Co.) under the following conditions: the amount of zirconia beads having a particle diameter of 0.3 mm packed: 80% by volume; liquid-feeding rate: 1 kg/h; disc circumferential speed: 6 m/sec; pass time: 25, to thereby prepare a wax dispersion liquid 1 having a solid content concentration of 20.8% by mass. Also, the wax contained in the dispersion liquid was found to have a volume average particle diameter of 0.15 μm.

[Preparation of Charge Controlling Agent Dispersion Liquid 1]

A container was charged with 5 parts of salicylic acid metal complex BONTRON E-84 (product of Orient Chemical Industries, Ltd.), 95 parts of ion-exchanged water and 0.5 parts of anionic surfactant NEOGEN R-K (product of DAI-ICHI KOGYO SEIYAKU CO., LTD.). The resultant mixture was treated with a beads mill ULTRA VISCO MILL (product of Aymex Co.) under the following conditions: the amount of zirconia beads having a particle diameter of 0.3 mm packed: 80% by volume; liquid-feeding rate: 1 kg/h; disc circumferential speed: 6 m/sec; pass time: 5, to thereby prepare a charge controlling agent dispersion liquid 1 having a solid content concentration of 4.8% by mass. Also, the charge controlling agent contained in the dispersion liquid was found to have a volume average particle diameter of 0.15 μm.

Example 3-1

The pigment dispersion liquid 1 (35.4 parts), 20.8 parts of the charge controlling agent dispersion liquid 1, 67.2 parts of the crystalline polyester dispersion liquid 5, 634.1 parts of the non-crystalline polyester dispersion liquid 1 and 28.8 parts of the wax dispersion liquid 1 were stirred using a disperser at 25° C. for 2 hours. Next, the resultant mixture was increased in temperature to 60° C. and then adjusted in pH to 7.0 with ammonia. Thereafter, the obtained mixture was increased in temperature to 90° C. and maintained for 6 hours, to thereby obtain a dispersion slurry.

The dispersion slurry (100 parts) was filtrated under reduced pressure. Then, 100 parts of ion-exchanged water was added to the filtration cake, followed by mixing with a TK homomixer (product of PRIMIX Corporation) at 12,000 rpm for 10 min and then filtration. Next, 10% by mass hydrochloric acid was added to the obtained filtration cake so that the pH thereof was adjusted to 2.8, followed by mixing with a TK homomixer (product of PRIMIX Corporation) at 12,000 rpm for 10 min and then filtration. Next, 300 parts of ion-exchanged water was added to the obtained filtration cake, followed by mixing with a TK homomixer (product of PRIMIX Corporation) at 12,000 rpm for 10 min and then filtration. A series of the above treatments were performed twice. The obtained filtration cake was dried with an air-circulating drier at 45° C. for 48 hours, and then was classified with a mesh having an aperture of 75 μm. The classified product was annealed at 55° C. for 50 hours to obtain base particles.

Using HENSCHEL MIXER (product of Mitsui Mining Co.), 100 parts of the obtained base particles was mixed with 0.7 parts of hydrophobic silica HDK-2000 having an average primary particle diameter of 20 nm (product of WACKER ASAHIKASEI SILICONE CO., LTD.) and 0.3 parts of hydrophobic titanium oxide having an average primary particle diameter of 20 nm, to thereby obtain a toner. The obtained toner was found to have a glass transition temperature of 50° C. where the glass transition temperature was determined from a DSC curve obtained in the first elevation of temperature, have a temperature width W of 7.9° C. where the temperature width W was a temperature width at ⅓ the height of an endothermic peak in the DSC curve of the toner obtained in the first elevation of temperature thereof, and also have a ½ effluent temperature $T_{1/2}$ of 125° C.

Example 3-2

The procedure of Example 3-1 was repeated, except that the time for which the classified product was annealed was changed to 100 hours, to thereby obtain a toner. The obtained toner was found to have a glass transition temperature of 50° C. where the glass transition temperature was determined from a DSC curve obtained in the first elevation of temperature, have a temperature width W of 5.5° C. where the temperature width W was a temperature width at ⅓ the height of an endothermic peak in the DSC curve of the toner obtained in the first elevation of temperature thereof, and also have a ½ effluent temperature $T_{1/2}$ of 125° C.

Comparative Example 3-1

The procedure of Example 3-1 was repeated, except that the classified product was not annealed, to thereby obtain a toner. The obtained toner was found to have a glass transition temperature of 50° C. where the glass transition temperature was determined from a DSC curve obtained in the first elevation of temperature, have a temperature width W of 10.9° C. where the temperature width W was a temperature width at ⅓ the height of an endothermic peak in the DSC curve of the toner obtained in the first elevation of temperature thereof, and also have a ½ effluent temperature $T_{1/2}$ of 125° C.

Comparative Example 3-2

The procedure of Example 3-1 was repeated, except that the annealing temperature of the classified product was changed to 62° C., to thereby obtain a toner. The obtained toner was found to have a glass transition temperature of 50° C. where the glass transition temperature was determined from a DSC curve obtained in the first elevation of temperature thereof, have a temperature width W of 9.8° C. where the temperature width W was a temperature width at ⅓ the height of an endothermic peak in the DSC curve of the toner obtained in the first elevation of temperature thereof, and also have a ½ effluent temperature $T_{1/2}$ of 125° C.

[Temperature Width W at ⅓ the Height of an Endothermic Peak]

The temperature width W at ⅓ the height of an endothermic peak in a DSC curve of the toner obtained in the first elevation thereof was measured with a thermal analyzer Q200 (product of TA INSTRUMENTS Co.). Specifically, first, about 5.0 mg of the toner was precisely weighed and placed in a sample container made of aluminum; the sample container was placed on a holder unit; and the holder unit was set in an electric furnace. Next, with the flow rate of nitrogen being set to 50 mL/min, the sample was heated from −20° C. to 150° C. under the following conditions: temperature increasing rate: 1° C./min, temperature modulation cycle: 60 sec, temperature modulation amplitude: 0.159° C.; and then, was cooled from 150° C. to 0° C. at a temperature decreasing rate of 10° C./min. In the obtained DSC curve, the endothermic peak in the first elevation of temperature was selected to determine a temperature width W at a region distant from the baseline L by ⅓ the distance from the baseline L to the top T of the endothermic peak P according to the method described above in detail.

[½ Effluent Temperature $T_{1/2}$]

The ½ effluent temperature $T_{1/2}$ of each toner was measured with an elevation-type flow tester model CFT500 (product of Shimadzu Corporation) under the following conditions.

Load: 30 kgf/cm$^2$

Temperature increasing rate: 3.0° C./min

Opening size of die: 0.50 mm

Length of die: 10.0 mm

Next, the toner was evaluated for minimum fixing temperature, heat resistant storage stability and image quality.

[Minimum Fixing Temperature]

A fixing portion of the copier MF-2200 (product of Ricoh Company, Ltd.) employing a TEFLON (registered trade mark) roller as a fixing roller was modified to produce a modified copier. This modified copier was used to perform a printing test using Type 6200 paper sheets (product of Ricoh Company, Ltd.). Specifically, printing was performed with the fixing temperature changed, to thereby determine a cold offset temperature (minimum fixing temperature). Notably, the evaluation conditions employed for determining the minimum fixing temperature were set as follows: paper-feeding linear velocity: 120 mm/s to 150 mm/s, surface pressure: 1.2 kgf/cm$^2$, and nip width: 3 mm.

[Heat Resistant Storage Stability]

After having been stored at 50° C. for 8 hours, the toner was sieved with a metal sieve having an aperture of 355 μm (42 mesh) for 2 min. Then, the toner remaining on the metal sieve (residual rate) was measured to evaluate heat resistant storage stability. Notably, the following criteria were employed for the evaluation.

A: Residual rate<10%

B: 10%≤Residual rate<20%

C: 20%≤Residual rate<30%

D: 30%≤Residual rate

[Image Quality]

The toner was stored in the product form at 40° C. and 70% RH for 14 days. Thereafter, the toner was used for continuous printing of a black solid image on 100 sheets by means of IMAGIO NEO 450 (product of Ricoh Company Ltd.) which could output 45 A4-sheets per minute. The resulting images were evaluated for image quality based on the following criteria.

A: Occurrence of black line<10%

B: 10%≤Occurrence of black line<15%

C: 15%≤Occurrence of black line<20%

D: 20%≤Occurrence of black line

Table 1 shows evaluation results of the toners.

TABLE 1

| | Tg [° C.] | W [° C.] | $T_{1/2}$ [° C.] | Min. fixing temp. [° C.] | Heat resistant storage stability | Image quality |
|---|---|---|---|---|---|---|
| Ex. 1-1 | 52 | 6.8 | 120 | 120 | B | B |
| Ex. 1-2 | 52 | 4.1 | 120 | 125 | A | A |
| Ex. 1-3 | 52 | 6.7 | 120 | 120 | B | B |
| Comp. Ex. 1-1 | 52 | 10.8 | 120 | 115 | C | D |
| Comp. Ex. 1-2 | 44 | 6.2 | 120 | 115 | D | D |
| Ex. 2-1 | 55 | 8.0 | 130 | 120 | C | C |
| Ex. 2-2 | 55 | 5.6 | 130 | 125 | A | A |
| Ex. 2-3 | 55 | 2.0 | 135 | 135 | B | B |
| Comp. Ex. 2-1 | 60 | 11.2 | 130 | 115 | D | D |
| Comp. Ex. 2-2 | 55 | 9.5 | 135 | 125 | C | D |
| Comp. Ex. 2-3 | 55 | 10.3 | 130 | 115 | D | D |
| Ex. 3-1 | 50 | 7.9 | 125 | 120 | B | B |
| Ex. 3-2 | 50 | 5.5 | 125 | 125 | A | A |
| Comp. Ex. 3-1 | 50 | 10.9 | 125 | 115 | C | D |
| Comp. Ex. 3-2 | 50 | 9.8 | 125 | 115 | D | D |

Note that Tg means a glass transition temperature determined from a DSC curve obtained in the first elevation of temperature.

As is clear from Table 1, the toners of Examples were superior in low-temperature fixability, heat resistant storage stability and image quality.

In contrast, the toners of Comparative Examples 1-1, 2-1, 2-2 and 3-1 each had a temperature width W exceeding 8° C., the temperature width W being a temperature width at ⅓ the height of an endothermic peak in a DSC curve of the toner obtained in the first elevation of temperature thereof. Thus, these toners were inferior in heat resistant storage stability and also in image quality.

The toner of Comparative Example 1-2 had a glass transition temperature of lower than 45° C., the glass transition temperature being determined from a DSC curve obtained in the first elevation of temperature. Thus, this toner was inferior in heat resistant storage stability and also in image quality.

Since each of the toners of Comparative Examples was found to have a lower minimum fixing temperature, the crystalline polyester and the non-crystalline polyester were thought to be compatible together.

REFERENCE SIGNS LIST

L: Baseline
P: Endothermic peak
T: Top
W: Temperature width
$L_1$: Tangential line
$L_2$: Baseline
P': Endothermic peak
X: Onset temperature

The invention claimed is:

1. A toner comprising:

base particles comprising a crystalline polyester and a non-crystalline polyester, wherein the toner has a glass transition temperature of 45° C. or higher and a temperature width of 8° C. or lower, the glass transition temperature is determined from a DSC curve of the toner obtained in a first elevation of temperature thereof, and the temperature width is a temperature width at ⅓ of an endothermic peak height in the DSC curve.

2. The toner according to claim 1, wherein the base particles each further comprises a urea-modified polyester.

3. The toner according to claim 1, wherein the crystalline polyester has a melting point of from 60° C. to 80° C. determined from a DSC curve of the crystalline polyester obtained in a first elevation of temperature thereof.

4. The toner according to claim 1, further comprising a colorant and a releasing agent.

5. The toner according to claim 1, wherein the toner has a ½ effluent temperature of from 110° C. to 140° C.

6. A method for producing the toner according to claim 1, the method comprising either:

(A) dissolving or dispersing the crystalline polyester and the non-crystalline polyester in an organic solvent having a temperature of 30° C. or lower, to prepare a first liquid, mixing the first liquid with materials comprising a colorant and a releasing agent, to prepare a second liquid, emulsifying or dispersing the second liquid in an aqueous medium, to thereby prepare a third liquid, and removing the organic solvent from the third liquid;

or:

(B) emulsifying or dispersing the crystalline polyester in an aqueous medium to prepare a first liquid, emulsifying or dispersing the non-crystalline polyester in an aqueous medium to prepare a second liquid, emulsifying or dispersing a colorant in an aqueous medium to prepare a third liquid, emulsifying or dispersing a releasing agent in an aqueous medium to prepare a fourth liquid, mixing together the first liquid, the second liquid, the third liquid and the fourth liquid to aggregate particles, to prepare a liquid comprising aggregated particles, heating the liquid comprising the aggregated particles to a temperature that is equal to or higher than a melting point of the crystalline polyester and equal to or higher than a glass transition temperature of the non-crystalline polyester, to fuse the aggregated particles with each other, thereby obtaining fused particles, and annealing the fused particles for 48 hours or longer at a temperature falling into a range of an onset temperature ±5° C., wherein the onset temperature is determined from the DSC curve of the crystalline polyester obtained in a first elevation of temperature thereof;

wherein the crystalline polyester has a melting point of from 60° C. to 80° C. determined from a DSC curve of the crystalline polyester obtained in the first elevation of temperature thereof, and the non-crystalline polyester has a glass transition temperature of from 45° C. to 65° C. determined from a DSC curve of the non-crystalline polyester obtained in a first elevation of temperature thereof.

7. The method according to claim 6, comprising:

emulsifying or dispersing the crystalline polyester in an aqueous medium to prepare a first liquid;

emulsifying or dispersing the non-crystalline polyester in an aqueous medium to prepare a second liquid;

emulsifying or dispersing a colorant in an aqueous medium to prepare a third liquid;

emulsifying or dispersing a releasing agent in an aqueous medium to prepare a fourth liquid;

mixing together the first liquid, the second liquid, the third liquid and the fourth liquid to aggregate particles, to prepare a liquid comprising aggregated particles;

heating the liquid comprising the aggregated particles to a temperature that is equal to or higher than a melting point of the crystalline polyester and equal to or higher than a glass transition temperature of the non-crystalline polyester, to fuse the aggregated particles with each other, thereby obtaining fused particles; and annealing the fused particles for 48 hours or longer at a temperature falling into a range of an onset temperature ±5° C., wherein the onset temperature is determined from the DSC curve of the crystalline polyester obtained in the first elevation of temperature thereof.

8. The method according to claim 6, comprising:

dissolving or dispersing the crystalline polyester and the non-crystalline polyester in an organic solvent having a temperature of 30° C. or lower, to prepare a first liquid;

mixing the first liquid with materials comprising a colorant and a releasing agent, to prepare a second liquid;

emulsifying or dispersing the second liquid in an aqueous medium, to prepare a third liquid; and removing the organic solvent from the third liquid.

9. A method for producing the toner according to claim 1, the method comprising:

kneading materials comprising the crystalline polyester, the non-crystalline polyester, a colorant and a releasing agent at a temperature of 100° C. or lower, thereby obtaining kneaded materials;

pulverizing the kneaded materials, thereby obtaining pulverized materials;

classifying the pulverized materials, thereby obtaining classified materials; and annealing the classified materials for 48 hours or longer at a temperature falling into a range of an onset temperature ±5° C., wherein the crystalline polyester has a melting point of from 60° C. to 80° C. determined from the DSC curve of the crystalline polyester obtained in a first elevation of temperature thereof, the non-crystalline polyester has a glass transition temperature of from 45° C. to 65° C. determined from a DSC curve of the non-crystalline polyester obtained in a first elevation of temperature thereof, and the onset temperature is determined from a DSC curve of the crystalline polyester obtained in the first elevation of temperature thereof.

10. A developer comprising:

the toner according to claim 1; and a carrier.

* * * * *